US008930094B2

(12) United States Patent
Torii

(10) Patent No.: US 8,930,094 B2
(45) Date of Patent: Jan. 6, 2015

(54) CONTROL DEVICE FOR HYDRAULIC WINCH

(71) Applicant: Hitachi Sumitomo Heavy Industries Construction Crane Co., Ltd., Tokyo (JP)

(72) Inventor: Koji Torii, Kasumigaura (JP)

(73) Assignee: Hitachi Sumitomo Heavy Industries Construction Crane Co., Ltd., Tokyo (JP)

( * ) Notice: Subject to any disclaimer, the term of this patent is extended or adjusted under 35 U.S.C. 154(b) by 50 days.

(21) Appl. No.: 13/894,133

(22) Filed: May 14, 2013

(65) Prior Publication Data

US 2013/0311051 A1 Nov. 21, 2013

(30) Foreign Application Priority Data

May 15, 2012 (JP) ..... 2012-111423

(51) Int. Cl.
*B66C 13/20* (2006.01)

(52) U.S. Cl.
CPC ..... *B66C 13/20* (2013.01)
USPC ..... 701/50; 701/123

(58) Field of Classification Search
USPC ..... 701/50, 123
See application file for complete search history.

(56) References Cited

U.S. PATENT DOCUMENTS

| | | | | |
|---|---|---|---|---|
| 4,453,430 | A * | 6/1984 | Sell | 475/116 |
| 4,462,079 | A * | 7/1984 | Ito et al. | 701/123 |
| 5,842,684 | A * | 12/1998 | Aho | 254/344 |
| 7,900,893 | B2 * | 3/2011 | Teurlay et al. | 254/270 |
| 7,922,153 | B2 * | 4/2011 | Zhou et al. | 254/344 |
| 8,600,652 | B2 * | 12/2013 | Mizutani | 701/123 |
| 2007/0219694 | A1 * | 9/2007 | Krimbacher | 701/50 |
| 2008/0078980 | A1 * | 4/2008 | Aho et al. | 254/344 |
| 2011/0276261 | A1 * | 11/2011 | Mizutani | 701/123 |

FOREIGN PATENT DOCUMENTS

JP 2009-155022 A 7/2009

* cited by examiner

*Primary Examiner* — Mary Cheung
*Assistant Examiner* — Michael Berns
(74) *Attorney, Agent, or Firm* — Crowell & Moring LLP

(57) ABSTRACT

A control device for a hydraulic winch includes: a hydraulic source; a variable-displacement hydraulic motor; a winch operation member; an accelerator operation quantity detection unit; an engine control unit; a rotation speed detection unit; a line pull detection unit; a condition decision unit; and a motor displacement control unit, wherein: once the condition decision unit decides that the fuel-efficient, high-speed operation condition has been established, the engine control unit sets an upper limit to the engine rotation speed at a predetermined rotation speed, lower than the maximum rotation speed.

9 Claims, 14 Drawing Sheets

CONTROL DEVICE FOR HYDRAULIC WINCH

INCORPORATION BY REFERENCE

The disclosure of the following priority application is herein incorporated by reference: Japanese Patent Application No. 2012-111423 filed May 15, 2012

BACKGROUND OF THE INVENTION

1. Field of the Invention

The present invention relates to a control device for a hydraulic winch.

2. Description of Related Art

Japanese Laid Open Patent Publication No. 2009-155022 discloses a control device for a hydraulic winch, which controls the minimum motor displacement in correspondence to the engine rotation speed. The control device for a hydraulic winch disclosed in the publication cited above regulates the minimum value taken for the motor displacement to be a first minimum displacement when the engine rotation speed is higher than a predetermined value and to be a second minimum displacement, smaller than the first minimum displacement, when the engine rotation speed is equal to or lower than the predetermined value, thereby achieving better fuel efficiency and noise reduction.

SUMMARY OF THE INVENTION

The control device for a hydraulic winch disclosed in the publication cited above regulates the motor displacement minimum value to be the second minimum displacement regardless of the level of the line pull. This means that even when there is a significant line pull, e.g., even when a heavy load is being hoisted, a winch drum may be controlled so that it rotates at high speed. This gives rise to an issue in that, as the hook to which the suspended load is attached, being lowered or raised, is stopped, a significant shock may occur.

A control device for a hydraulic winch according to a first aspect of the present invention, comprises: a hydraulic source; a variable-displacement hydraulic motor that is caused to rotate by pressure oil from the hydraulic source and is used to drive a winch drum; a winch operation member that outputs a low-speed hoisting/lowering command so as to hoist/lower a hook at low speed when operated to a low-speed side hoisting/lowering operating position and outputs a high-speed hoisting/lowering command so as to hoist/lower the hook at high speed when operated to a high-speed side hoisting/lowering operating position; an accelerator operation quantity detection unit that detects an operation quantity of an accelerator operation member; an engine control unit that controls an engine rotation speed at an engine within a range between a minimum rotation speed and a maximum rotation speed, in correspondence to the operation quantity at the accelerator operation member detected by the accelerator operation quantity detection unit; a rotation speed detection unit that detects the engine rotation speed; a line pull detection unit that detects a line pull at a hoisting rope; a condition decision unit that decides that a fuel-efficient, high-speed operation condition is established in response to an operation performed at the winch operation member to switch from the low-speed side hoisting/lowering operating position to the high-speed side hoisting/lowering operating position when the engine rotation speed detected by the rotation speed detection unit is equal to or lower than a predetermined rotation speed and the line pull detected by the line pull detection unit is equal to or less than a predetermined value; and a motor displacement control unit that reduces a motor displacement of the hydraulic motor and controls the motor displacement at a minimum displacement once the condition decision unit decides that the fuel-efficient, high-speed operation condition has been established, wherein: once the condition decision unit decides that the fuel-efficient, high-speed operation condition has been established, the engine control unit sets an upper limit to the engine rotation speed at a predetermined rotation speed, lower than the maximum rotation speed.

According to a second aspect of the present invention, in the control device for a hydraulic winch according to the first aspect, it is preferable that the hydraulic source includes at least two hydraulic pumps; the control device further comprises two directional control valves each switched in response to a command output from the winch operation member, which individually control flows of pressure oil output from the two hydraulic pumps, to the hydraulic motor; in response to the low-speed hoisting/lowering command output from the winch operation member, only one of the directional control valves is switched so as to deliver pressure oil from one of the two hydraulic pumps to the hydraulic motor; and in response to the high-speed hoisting/lowering command output from the winch operation member, the directional control valves are both switched so as to deliver pressure oil from the two hydraulic pumps to the hydraulic motor.

According to a third aspect of the present invention, in the control device for a hydraulic winch according to the first aspect, the rotation speed detection unit may detect an actual rotation speed of the engine.

According to a fourth aspect of the present invention, the control device for a hydraulic winch according to the first aspect may further comprise: a mode selector operation member that selectively switches to a limit mode, in which the motor displacement at the hydraulic motor is controlled by the motor displacement control unit at the minimum displacement when the fuel-efficient, high-speed operation condition has been established or to a no-limit mode in which the motor displacement at the hydraulic motor is not controlled at the minimum displacement even if the fuel-efficient, high-speed operation condition has been established.

According to a fifth aspect of the present invention, the control device for a hydraulic winch according to the fourth aspect may further comprise: an auxiliary selector switch that either validates or invalidates the limit mode having been selected by the mode selector operation member, wherein: the accelerator operation member includes a handle portion held by an operator seated in an operator's seat; and the auxiliary selector switch is disposed at the handle portion of the accelerator operation member.

According to a sixth aspect of the present invention, in the control device for a hydraulic winch according to the first aspect, it is preferable that, if the winch operation member is moved from the high-speed side hoisting/lowering operating position to the low-speed side hoisting/lowering operating position while the motor displacement control unit is controlling the motor displacement at the hydraulic motor at the minimum displacement, the motor displacement control unit executes control so as to adjust the motor displacement at the hydraulic motor to a predetermined displacement, greater than the minimum displacement.

According to a seventh aspect of the present invention, in the control device for a hydraulic winch according to the first aspect, it is preferable that, if the line pull detected by the line pull detection unit becomes greater than the predetermined value when the upper limit to the engine rotation speed set by the engine control unit represents a predetermined rotation speed, which is lower than the maximum rotation speed, the engine control unit adjusts the upper limit to the engine rotation speed to the maximum rotation speed.

According to an eighth aspect of the present invention, in the control device for a hydraulic winch according to the first aspect, it is preferable that, if the winch operation member is determined to have been operated so as to switch from the high-speed side hoisting/lowering operating position to the low-speed side hoisting/lowering operating position and a command value detected by the accelerator operation quantity detection unit is determined to be less than the predetermined rotation speed while the engine control unit is controlling the upper limit to the engine rotation speed at the predetermined rotation speed, the engine control unit adjusts the upper limit to the engine rotation speed to the maximum rotation speed.

According to a ninth aspect of the present invention, the control device for a hydraulic winch according to the first aspect may further comprise: a cutoff unit that regulates the motor displacement when a circuit pressure of the hydraulic motor exceeds a predetermined cutoff pressure; and a cutoff control unit that raises the predetermined cutoff pressure once the condition decision unit decides that the fuel-efficient, high-speed operation condition has been established.

DESCRIPTION OF PREFERRED EMBODIMENT

The following is a description of a crawler crane (hereafter simply referred to as a crane) with a control device for a hydraulic winch (hydraulic winch control device) achieved in an embodiment of the present invention installed therein, given in reference to drawings.

Figure 1:
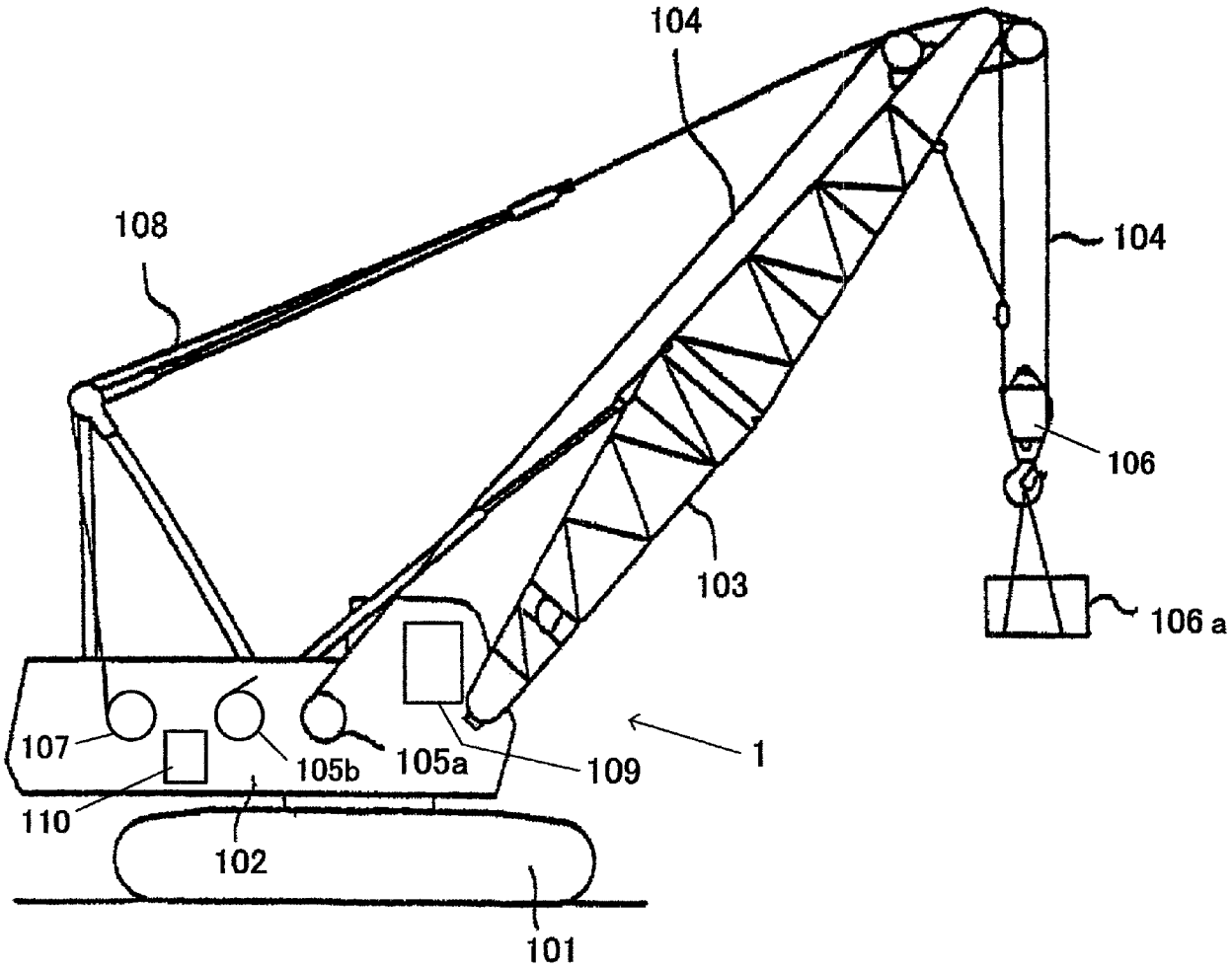
FIG. 1 is a side elevation providing an external view of a crane at which a hydraulic winch control device achieved in an embodiment of the present invention is installed.

FIG. 1 is a side elevation providing an external view of a crane 1 with the hydraulic winch control device achieved in the embodiment installed therein. As shown in FIG. 1, the crane 1 includes a traveling carrier 101 equipped with a pair of crawlers, a rotatable revolving superstructure 102 mounted on the traveling carrier 101, and a boom 103 supported at the revolving superstructure 102 and capable of being raised and lowered. An engine 110 that acts as a motive power source in the crane 1 and three winch drums (a front drum 105*a*, a rear drum 105*b* and a boom hoisting drum 107) are mounted at the revolving superstructure 102.

As the front drum 105*a* is driven, a front drum wire rope (lifting rope) 104 is spooled in or spooled out, thereby raising or lowering a load 106*a* suspended at a main hook 106. It is to be noted that FIG. 1 does not include an illustration of a rear drum wire rope that is spooled in or spooled out as the rear drum 105*b* is driven or an auxiliary hook that is raised or lowered via this wire rope. As the boom hoisting drum 107 is driven, a boom hoisting rope 108 is spooled in or spooled out, thereby hoisting or lowering the boom 103.

Figure 2:
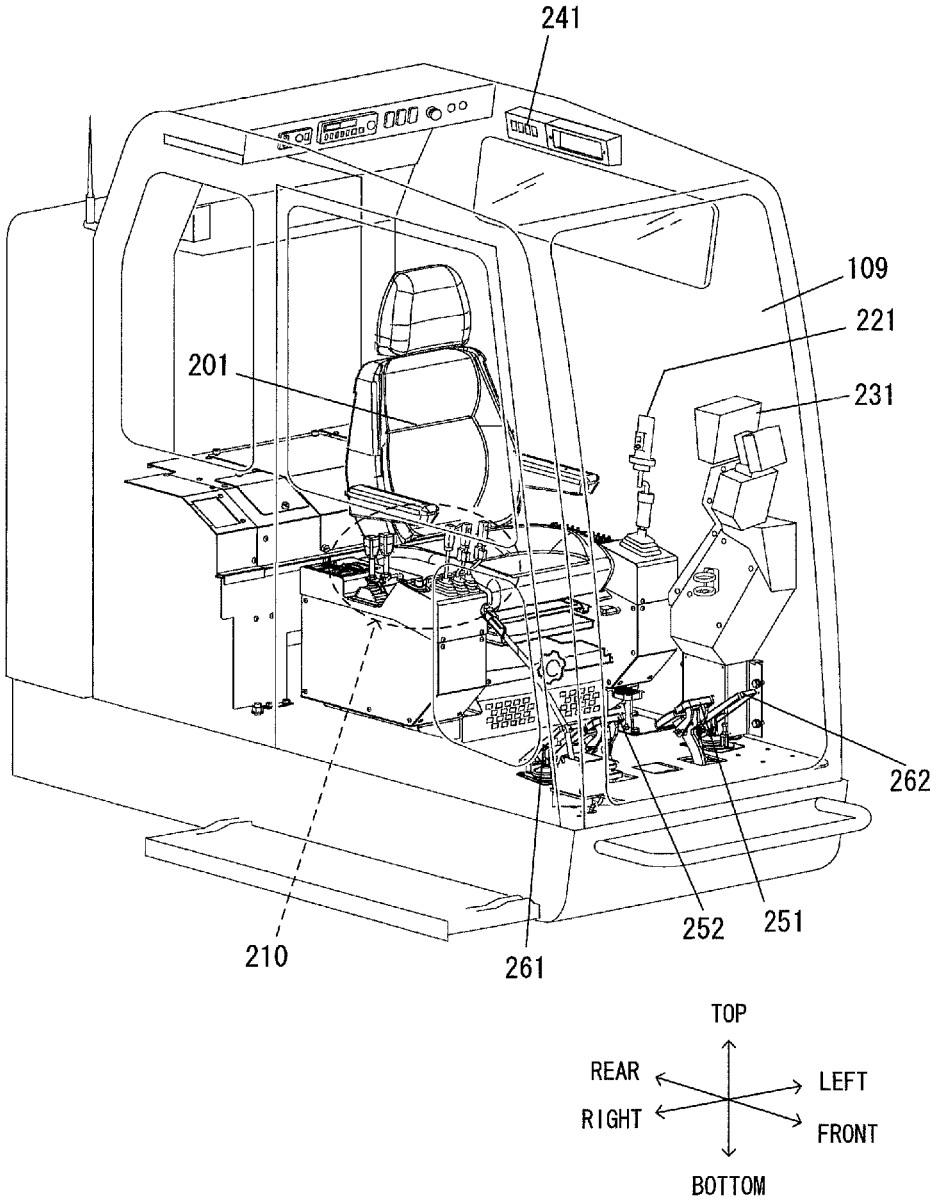
FIG. 2 is a perspective providing an overall view of an operator's cab.

As FIG. 1 shows, an operator's cab 109 is located at the revolving superstructure 102. FIG. 2 is a perspective providing an overall view of the operator's cab 109. In the operator's cab 109, an operator's seat 201 where an operator sits, a right-side lever group 210 made up with levers operated by the operator seated in the operator's seat 201 with his right hand, and a left-side lever (revolution lever) 221 operated by the operator seated in the operator's seat 201 with his left hand are disposed. A display device 231 is disposed to the front of the operator's seat 201 on the left side, whereas an energy saving mode switch 241 is disposed near the ceiling on the left side of the operator's cab 109.

A front drum brake pedal 251, operated to apply braking at the front drum 105*a*, a rear drum brake pedal 252 operated to apply braking at the rear drum 105*b*, an accelerator pedal 261 operated to increase/decrease the rotation speed of the engine 110, and a revolution brake pedal 262 operated to apply braking at the revolving superstructure 102, are disposed on the floor of the operator's cab 109.

Figure 3:
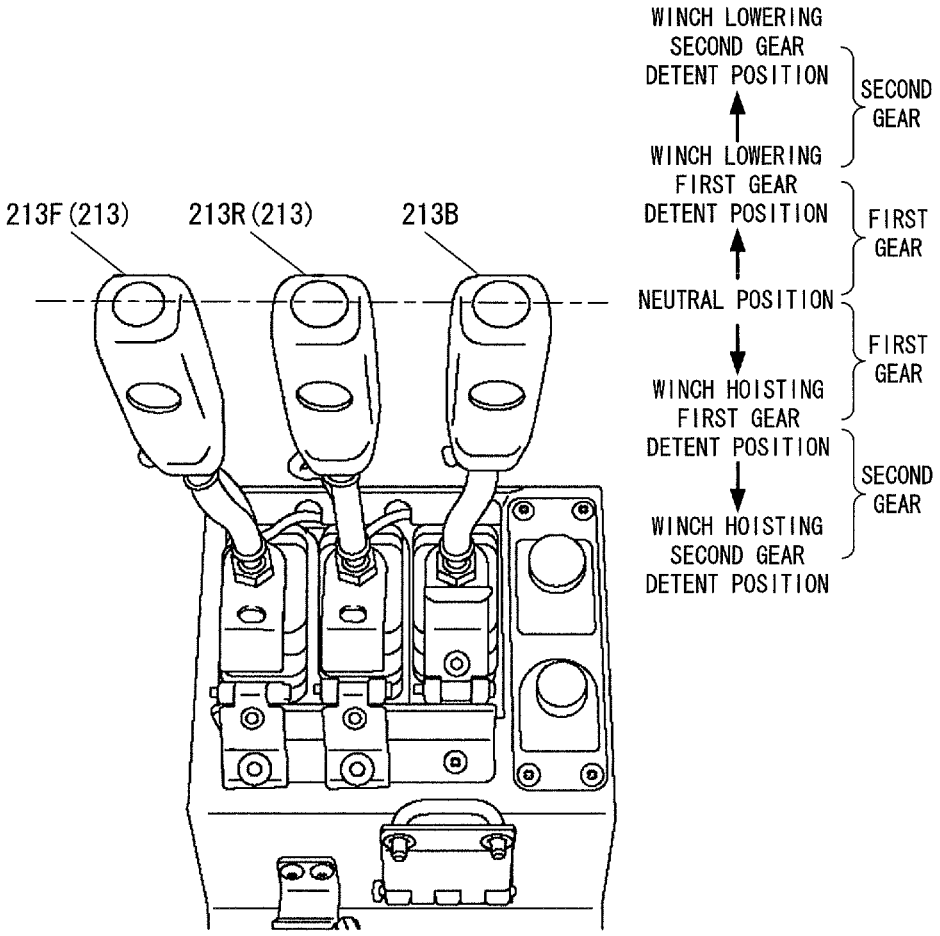
FIG. 3 illustrates operating positions taken at winch operation levers.

The right-side lever group 210 includes a front winch operation lever 213F, a rear winch operation lever 213R and a boom hoisting winch operation lever 213B shown in FIG. 3, as well as a pair of traveling levers, i.e., a traveling lever operated to drive the left-side crawler and a traveling lever operated to drive the right-side crawler. The traveling levers are operation levers, each moved along the frontward/rearward direction so as to drive the right-side crawler or the left-side crawler. The front winch operation lever 213F is an operation lever moved frontward/rearward so as to drive the front drum 105*a*, whereas the rear winch operation lever 213R is an operation lever moved frontward/rearward so as to drive the rear drum 105*b*. The boom hoisting winch operation lever 213B is an operation lever moved frontward/rearward so as to drive the boom hoisting drum 107.

In reference to FIG. 3, operating positions selected at the front winch operation lever 213F and the rear winch operation lever 213R will be explained. As the front winch operation lever 213F is moved from the neutral position toward the front of the vehicle by a predetermined angle, it becomes detent-locked via a detent mechanism of the known art and is thus held at a winch lowering first gear detent position. As the front winch operation lever 213F is moved from the winch spool out first gear detent position toward the front of the vehicle by a predetermined angle, it becomes detent locked via the detent mechanism and is held at a winch lowering second gear detent position. As the front winch operation lever 213F is moved from the neutral position toward the rear of the vehicle by a predetermined angle, it becomes detent-locked via the detent mechanism and is thus held at a winch hoisting first gear detent position. As the front winch operation lever 213F is moved from the winch spool in first gear detent position toward the rear of the vehicle by a predetermined angle, it becomes detent-locked via the detent mechanism and is held at a winch hoisting second gear detent position. As is the front winch operation lever 213F, the rear winch operation lever 213R is moved from the neutral position toward the front of the vehicle so as to take a winch lowering first gear detent position and a winch lowering second gear detent position, and is moved toward the rear of the vehicle to take a winch hoisting first gear detent position and a winch hoisting second gear detent position.

As the front winch operation lever 213F is operated to take the hoisting/lowering first gear detent position, a pilot pressure, which is equivalent to a low-speed hoisting/lowering command for spooling in/out the lifting rope 104 suspending the hook 106 at low speed, is output. As the front winch operation lever 213F is operated to take the hoisting/lowering second gear detent position, a pilot pressure, which is equivalent to a high-speed hoisting/lowering command for spooling in/out the lifting rope 104 suspending the hook 106 at high speed, is output.

Figure 4:
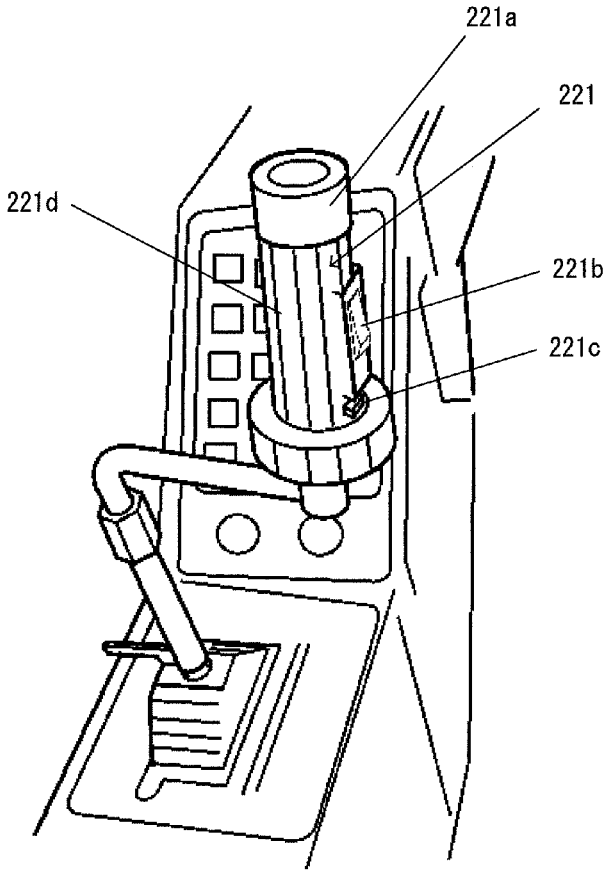
FIG. 4 shows a revolution lever.

The left-side lever in FIG. 2, i.e., the revolution lever 221, is an operation lever that is moved frontward/rearward so as to rotationally drive the revolving superstructure 102. As shown in FIG. 4, the revolution lever 221 includes a handle portion 221*d* held by the operator seated in the operator's seat 201. At the revolution lever 221, an accelerator grip 221*a*, a revolution brake switch 221*b* and an ECO (economy) switch 221*c* are disposed.

The accelerator grip 221*a* is an operation device operated by the operator who, holding it with his left hand, rotates it along the clockwise direction or the counterclockwise direction viewed from above so as to increase/decrease the rotation speed of the engine 110. The revolution brake switch 221*b* is a switch via which a choice is made as to whether or not to apply revolution braking so as to hold the revolving superstructure 102 at a fixed position by preventing it from revolving. The ECO switch 221*c* is located at the lower end of the handle portion 221*d* of the revolution lever 221 so that the operator, holding the revolution lever 221, can operate it with ease. The functions of the ECO switch 221*c* will be described in detail later.

Figure 5:
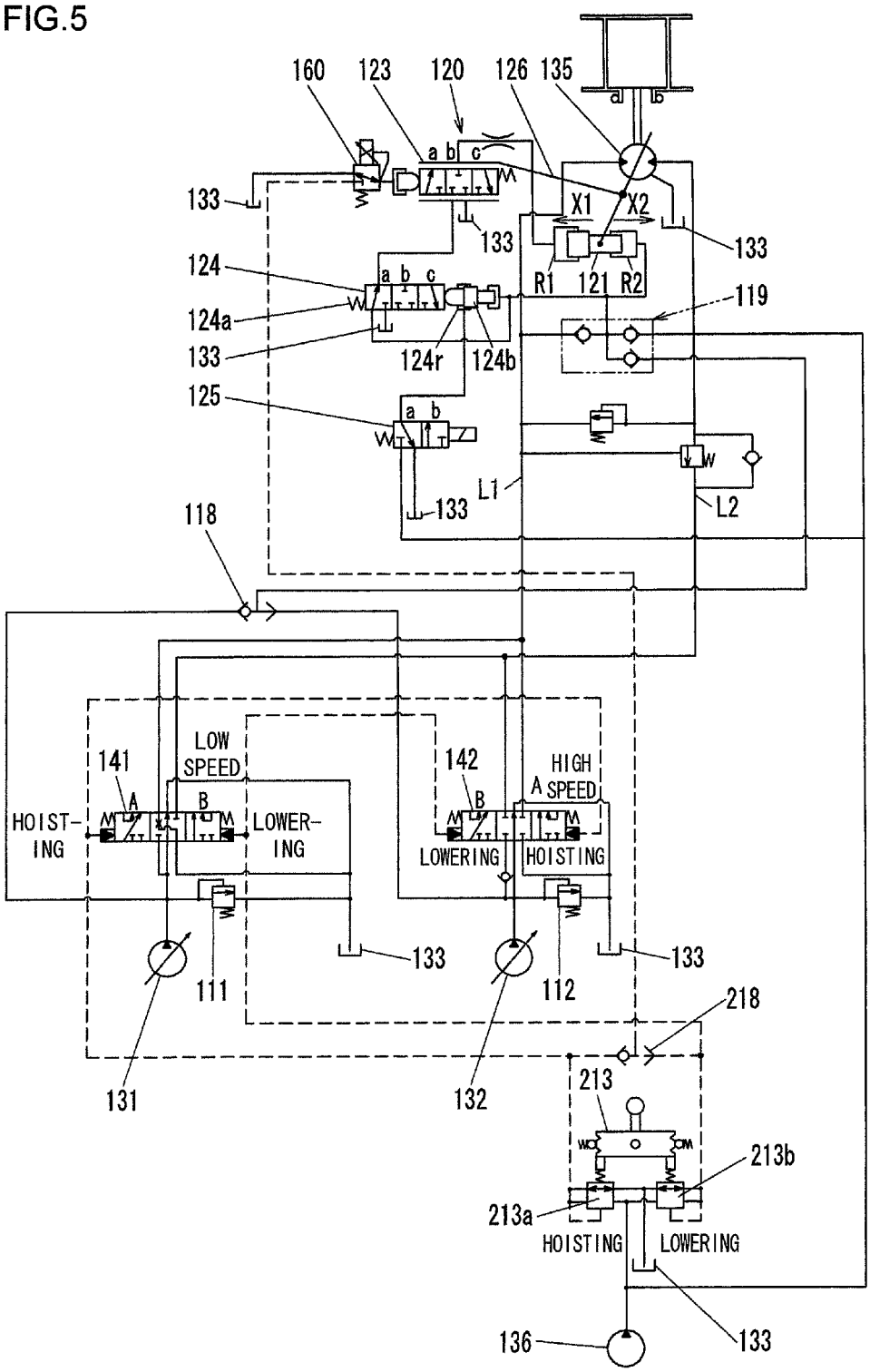
FIG. 5 schematically illustrates the structure of a hydraulic circuit for a winch.

FIG. 5 schematically illustrates the structure of a winch hydraulic circuit. This hydraulic circuit includes a first pump 131 and a second pump 132 driven by the engine (not shown), a pilot pump 136 driven by the engine (not shown), a hydraulic operating fluid reservoir 133 and a variable displacement hydraulic motor 135 that is caused to rotate with pressure oil output from the first pump 131 and the second pump 132. The hydraulic motor 135 is driven with pressure oil provided from the first pump 131 and the second pump 132 via a pair of main conduits L1 and L2.

The hydraulic motor 135 used to hoist/lower the hook attached to the lifting rope includes a front winch motor used to rotate the front drum 105*a* and a rear winch motor used to rotate the rear drum 105*b*. In order to simplify the illustration, FIG. 5 shows the front winch motor alone to represent the hydraulic motor 135 for driving the winch drum. In other words, FIG. 5 does not provide illustrations of the rear winch motor adopting a structure similar to that of the front winch motor and the hydraulic circuit that drives the rear winch motor.

The first pump 131 and the second pump 132 are variable displacement hydraulic pumps. The pump displacements are each controlled as the displacement angle is controlled via a displacement angle control device (not shown). The hydraulic motor 135 is driven with pressure oil from the first pump 131 and pressure oil from the second pump 132, the flows of which are controlled via a first directional control valve (low-speed valve) 141 and a second directional control valve (high-speed valve) 142. Either the pressure oil output from the first pump 131 alone is delivered to the hydraulic motor 135 or the pressure oil output from the first pump 131 and the pressure oil output from the second pump 132 combined in a merged flow is guided to the hydraulic motor 135.

The hydraulic circuit includes the first directional control valve 141 and the second directional control valve 142, the winch operation lever 213 (213F) via which a winch drive command is issued, pilot valves 213*a* and 213*b* via which a pilot pressure corresponding to the extent to which the winch operation lever 213 is operated is generated, and a motor displacement control device 120. The hydraulic circuit further includes a shuttle valve 218 via which either a hoisting secondary pressure originating from the pilot valve 213*a* or a lowering secondary pressure originating from the pilot valve 213*b* is selected.

The first directional control valve 141 controls the flow of pressure oil from the first pump 131 to the hydraulic motor 135, whereas the second directional control valve 142 controls the flow of pressure oil from the second pump 132 to the hydraulic motor 135. The first directional control valve 141 and the second directional control valve 142 are each a control valve adopting a hydraulic pilot operation system, controlled in correspondence to the operating direction along which the winch operation lever 213 (213F), disposed inside the operator's cab 109 as explained earlier, is operated and the operation quantity, i.e., the extent to which the winch operation lever 213 (213F) is operated.

As the first directional control valve 141 is switched to a position A, oil output from the first pump 131 is delivered to the hydraulic motor 135 via the main conduit L2, thereby causing the hydraulic motor 135 to rotate along the hoisting (spool-in) direction. As the first directional control valve 141 is switched to a position B, oil output from the first pump 131 is delivered to the hydraulic motor 135 via the main conduit L1, thereby causing the hydraulic motor 135 to rotate along the lowering (spool-out) direction. As the second directional control valve 142 is switched to a position A, oil output from the second pump 132 is delivered to the hydraulic motor 135 via the main conduit L2, thereby causing the hydraulic motor 135 to rotate along the hoisting (spool-in) direction. As the second directional control valve 142 is switched to the position B, oil output from the second pump 132 is delivered to the hydraulic motor 135 via the main conduit L1, thereby causing the hydraulic motor 135 to rotate along the lowering (spool-out) direction As the winch operation lever 213 is operated along the hoisting direction (toward the operator in FIG. 3) or along the lowering direction (away from the operator in FIG. 3) by an increasing extent, the secondary pressure (hereafter referred to as pilot pressure) provided from the pilot valve 213*a* or 213*b* increases. The pilot pressure is applied to the pilot portions of the first directional control valve 141 and the second directional control valve 142 and, as a result, switchover occurs at the first directional control valve 141 and the second directional control valve 142.

Figure 7:
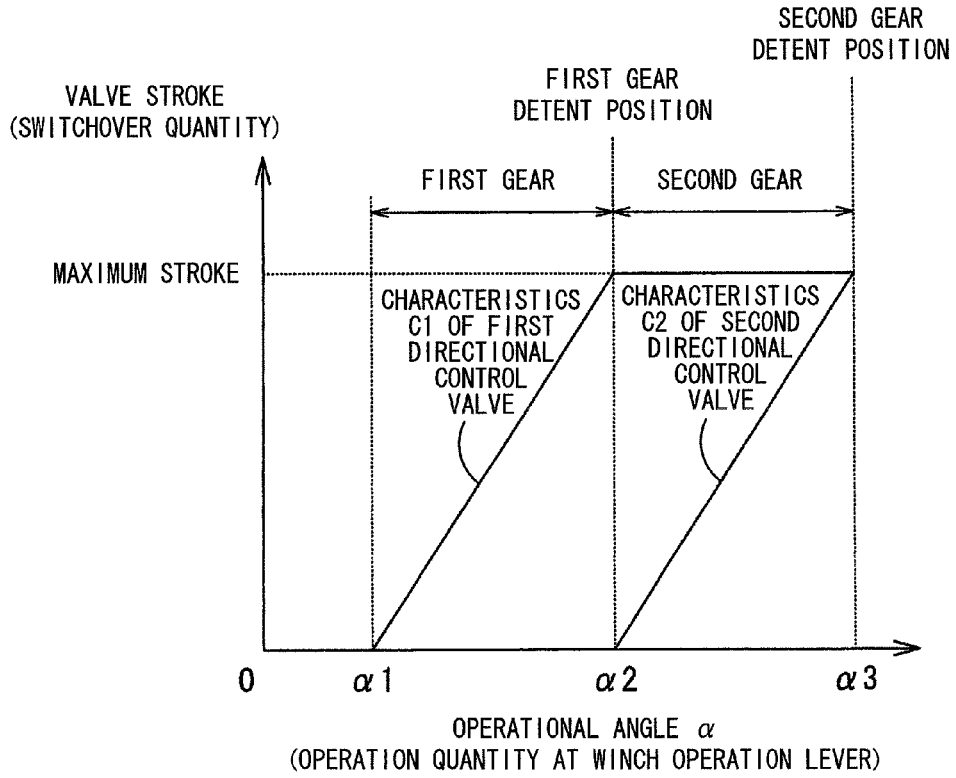
FIG. 7 presents an example of a relationship that may manifest between a winch operation lever operation quantity and the extents of switchover occurring at the first and second directional control valves.

FIG. 7 presents an example of a relationship that may manifest between the operation quantity at the winch operation lever 213 and the extents of switchover occurring at the first directional control valve 141 and the second directional control valve 142. Characteristics C1 in FIG. 7 represent the relationship between the operation quantity (operational angle) $\alpha$ at the winch operation lever 213 and the extent of switchover (valve stroke) at the first directional control valve (low-speed valve) 141. Characteristics C2 in FIG. 7 represent the relationship between the operation quantity $\alpha$ at the winch operation lever 213 and the extent of switchover at the second directional control valve (high-speed valve) 142.

As characteristics C1 indicate, the extent of switchover (valve stroke) at the first directional control valve 141 remains at zero as long as the operation quantity $\alpha$ is within the range of 0 through $\alpha$1, increases proportionally as the operation quantity $\alpha$ increases over a range of $\alpha$1 through $\alpha$2 and is held at the maximum switchover extent (maximum stroke) once the operation quantity becomes equal to or greater than $\alpha$2. As characteristics C2 indicate, the extent of switchover (valve stroke) at the second directional control valve 142 remains at zero as long as the operation quantity $\alpha$ is within the range of 0 through $\alpha$2, increases proportionally as the operation quantity $\alpha$ increases over a range of $\alpha$2 through $\alpha$3 and achieves the maximum switchover extent (maximum stroke) as the operation quantity $\alpha$ becomes $\alpha$3.

In the first gear (low speed) range ($\alpha 1<\alpha<\alpha 2$) over which the winch operation lever 213 is operated to a small operation quantity $\alpha$, the first directional control valve 141 alone is switched and the pressure oil output from the first pump 131 is delivered to the hydraulic motor 135. In the second gear (high speed) range ($\alpha 2<\alpha<\alpha 3$) over which the winch operation lever 213 is operated to a greater operation quantity $\alpha$, both the first directional control valve 141 and the second directional control valve 142 are switched and the pressure oil output from both the first pump 131 and the second pump 132 is delivered to the hydraulic motor 135. Through such a two-pump merging method, the quantity of pressure oil delivered to the hydraulic motor 135 can be increased with the increase in the operation quantity $\alpha$ at the winch operation lever 213. As a result, the hydraulic motor 135, while the winch operation lever is operated over the second gear range, is allowed to rotate at a higher rotation speed than the rotation speed at which the hydraulic motor 135 rotates while the winch operation lever is operated over the first gear range.

It is to be noted that a detent mechanism (not shown) of the known art disposed at the winch operation lever 213, as explained earlier, is engaged once the operation quantity a at the winch operation lever 213 becomes equal to $\alpha$2 so as to detent-lock the winch operation lever 213 at the hoisting/lowering first gear detent position (see FIG. 3). At this position, the lever operation quantity $\alpha$ will remain at $\alpha$2 even if the operator lets go of the winch operation lever 213. In addition, the detent mechanism is engaged as the operation quantity $\alpha$ at the winch operation lever 213 becomes equal to $\alpha$3 so as to detent-lock the winch operation lever 213 at the hoisting/lowering second gear detent position (see FIG. 3). At this position, the lever operation quantity $\alpha$ will remain at $\alpha$3 even if the operator lets go of the winch operation lever 213.

The structure of the motor displacement control device 120 will be described next. As shown in FIG. 5, the motor displacement control device 120 comprises a piston 121 that alters the motor tilt angle (may otherwise be referred to as "motor absorption volume"), a first high-pressure selection valve 118 that selects either the output pressure at the first pump 131 or the output pressure at the second pump 132 that is higher than the other, a second high-pressure selection valve 119 via which either the pressure oil provided through the first high-pressure selection valve 118 or the pressure oil flowing through the pair of main conduits L1 and L2, connected to the hydraulic motor 135, which achieves a higher pressure than the other is selected and the selected pressure oil is delivered to oil chambers R1 and R2 at the piston 121, a control valve 123 via which the flow of pressure oil to the oil chamber R1 is controlled, an electromagnetic proportional pressure-reducing valve 160 that reduces the pilot pressure provided from the shuttle valve 218 to the control valve 123 based upon a command issued by a controller, which will be described in detail later, a cutoff valve 124 that cuts off the flow of pressure oil from the second high-pressure selection valve 119 to the control valve 123, an electromagnetic switching valve 125 to be described later, and a feedback mechanism 126.

The piston diameter defined within the oil chamber R1 is greater than the piston diameter defined within the oil chamber R2, and thus, as the control valve 123 and the cutoff valve 124 are both switched to take up the position "a" in the figure, the piston 121 moves along an X2 direction in the figure, thereby reducing the motor displacement q (hereafter may be referred to as a "motor displacement volume"). In contrast, as the control valve 123 is switched to the position "c" and the pressure in the oil chamber R1 becomes equal to the tank pressure, the piston 121 moves along an X1 direction, thereby increasing the motor displacement q. It is to be noted that as the change in the motor displacement q is fed back to the control valve 123 via the feedback mechanism 126, the function of a servomechanism is achieved.

The control valve 123 is switched with the pilot pressure oil provided thereto via the electromagnetic proportional pressure-reducing valve 160. As shown in FIG. 5, a pilot pressure PL originating from the pilot valve 213*a* or the pilot valve 213*b* is delivered via the shuttle valve 218, to the electromagnetic proportional pressure-reducing valve 160 and subsequently, the pressure oil, the pressure of which has been reduced at the electromagnetic proportional pressure-reducing valve 160, is applied to the control valve 123.

Figure 6A:
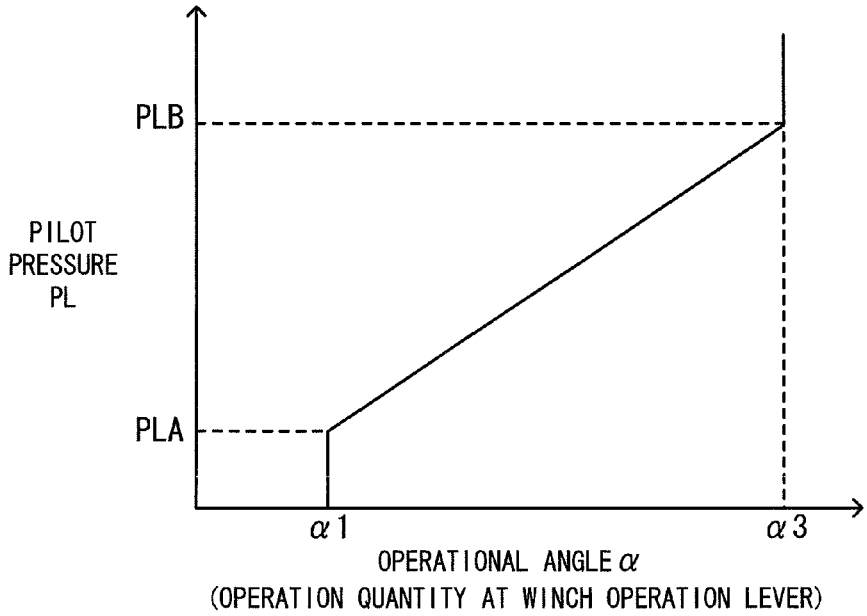
FIG. 6A indicates the relationship between a winch operation lever operation quantity representing the extent to which a winch operation lever is operated and the pilot pressure, whereas FIG. 6B indicates the relationship between the pilot pressure PL and the pressure PC applied to the control valve.
Figure 6B:
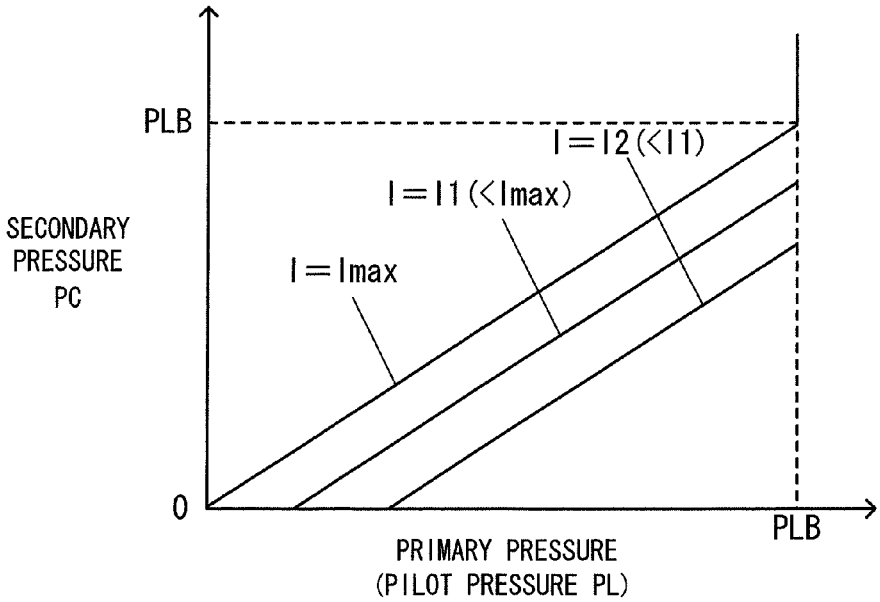

FIG. 6A indicates the relationship between the operation quantity at the winch operation lever 213 and the pilot pressure PL, whereas FIG. 6B indicates the relationship between the pilot pressure PL and the pressure PC applied to the control valve 123. As FIG. 6A indicates, the pilot pressure PL, which corresponds to the operational angle $\alpha$ (operation quantity) at the winch operation lever 213, is output from the pilot valve 213*a* or 213*b*. While the pilot pressure PL does not rise as long as the operational angle $\alpha$ is less than the predetermined value $\alpha$1, the pilot pressure PL rises to PLA once the operational angle $\alpha$ becomes equal to the predetermined value $\alpha$1. In the range over which the lever operational angle $\alpha$ is between $\alpha$1 and $\alpha$3, the pilot pressure PL increases proportionally to the lever operational angle $\alpha$.

The extent to which the pressure is reduced by the electromagnetic proportional pressure-reducing valve 160 is controlled with a control current I provided from a controller 150 (see FIG. 8) which will be described in detail later. As FIG. 6B indicates, valve characteristics whereby the extent of pressure reduction becomes less as the control current I input to a solenoid increases, i.e., a greater secondary pressure is provided as the control current I increases, are set as the valve characteristics of the electromagnetic proportional pressure-reducing valve 160. The control valve 123 is switched in correspondence to the secondary pressure PC achieved by reducing, via the electromagnetic proportional pressure-reducing valve 160, the pilot pressure PL output in correspondence to the operation quantity α at the winch operation lever 213.

As the secondary pressure increases, the control valve 123 is switched toward the position "a" to result in smaller motor displacement. In contrast, as the secondary pressure decreases, the control valve 123 is switched toward the position "c", resulting in greater motor displacement.

As has been explained above, the control valve 123 is controlled based upon pressure provided via the electromagnetic proportional pressure-reducing valve 160 engaged in operation by the controller 150 so as to adjust the pilot pressure PL, which is output in correspondence to the operation quantity α at the winch operation lever 123. For instance, in response to a first gear (low speed) or second gear (high-speed) command issued via the winch operation lever 213, the control current I set at either I1 or I2 is input to the electromagnetic proportional pressure-reducing valve 160. As a result, the pilot pressure PL is reduced to a predetermined degree, as indicated in FIG. 6B and a predetermined secondary pressure PC is thus applied at the control valve 123, thereby switching the control valve 123 to a first predetermined position (not shown) or a second predetermined position (not shown) between the position "a" and the position "b". As the control valve 123 is switched to the first predetermined position or the second predetermined position, the pressure oil provided via the second high-pressure selection valve 119 is slightly constrained at the control valve 123 and is then delivered to the oil chamber R1, causing the piston 121 to move along the X2 direction and thus reducing the motor displacement. The extent to which the motor displacement is reduced is fed back via the feedback mechanism 126 to the control valve 123. In response, the control valve 123 is switched to the position "b" and the motor displacement q becomes stabilized at a specific volume, which is greater than the minimum displacement qmin but smaller than the maximum displacement qmax.

As the winch operation lever 213 is operated from the hoisting first gear detent position toward the hoisting second gear detent position or from the lowering first gear detent position toward the lowering second gear detent position while energy saving mode condition, to be explained later, is present, a fuel-efficient, high-speed operation condition is established and the control current I set at Imax (maximum current) is output from the controller 150. As the winch operation lever 213 is operated with a full stroke, the pilot pressure PL at PLmax (maximum pilot pressure) is output from the pilot valve 213*a* or 213*b*. The maximum pilot pressure PLmax is directly applied to the control valve 123 without being reduced at the electromagnetic proportional pressure-reducing valve 160, and thus, the control valve 123 is switched to the position "a". As the control valve 123 is switched to the position "a", the pressure oil provided via the second high-pressure selection valve 119 is delivered to the oil chamber R1, causing the piston 121 to move along the X2 direction, and thus reducing the motor displacement. The extent of motor displacement reduction is fed back via the feedback mechanism 126 to the control valve 123. The control valve 123 is switched to the position "b" when the motor displacement q becomes equal to the minimum displacement qmin, and the motor displacement becomes stabilized in this state.

The cutoff valve 124 is switched in correspondence to the pressure of the pressure oil provided via the second high-pressure selection valve 119. If the pressure provided via the second high-pressure selection valve 119 is less than a cutoff pressure Pc, the cutoff valve 124 is switched to the position "a", so as to allow the pressure oil to be delivered from the second high-pressure selection valve 119 into the oil chamber R1. Once the pressure provided via the second high-pressure selection valve 119 becomes equal to the cutoff pressure Pc, the cutoff valve 124 is switched to the position "b". In this state, the supply of pressure oil into the oil chamber R1 is disallowed so as to ensure that the motor displacement does not decrease. As the pressure provided via the second high-pressure selection valve 119 becomes greater than the cutoff pressure Pc, the cutoff valve 124 is switched to the position "c", and in this state, the pressure oil in the oil chamber R1 is directed back into the reservoir 133 and the motor displacement increases.

A spring 124*a*, which is used for setting the cutoff pressure Pc, is disposed at the cutoff valve 124. The cutoff pressure Pc is set at a first cutoff pressure Pc1 with the force imparted by the spring 124*a*.

The control device achieved in the embodiment includes the electromagnetic switching valve 125, via which the cutoff pressure Pc is raised when the fuel-efficient, high-speed operation condition, to be described in detail later, is established. When the fuel-efficient, high-speed operation condition is established, the electromagnetic switching valve 125 is switched to the position "b". As the electromagnetic switching valve 125 is switched to the position "b", pressure oil output from the pilot pump 136 is delivered to an oil chamber 124*r* in the figure, which is used as a cutoff pressure-raising chamber. As the pressure of the pressure oil output from the pilot pump 136 is applied to the oil chamber 124*r*, a piston 124*b* is pushed along a direction matching the direction in which the force imparted by the spring 124*a* at the cutoff valve 124 is applied. As a result, the cutoff pressure Pc is raised to a second cutoff pressure Pc2. It is to be noted that the first cuts off pressure Pc1 and the second cutoff pressure Pc2 are both lower than a relief pressure (pump relief pressure) Pr at relief valves 111 and 112, which regulate the output pressures at the first pump 131 and the second pump 132 respectively (Pc1<Pc2<Pr).

The presence of the cutoff valve 124 in the hydraulic circuit achieved in the embodiment as described above makes it possible to regulate the motor displacement in correspondence to the circuit pressure at the hydraulic motor 135. Consequently, the circuit pressure rises as the load 106*a* is lowered and once the pressure exceeds the cutoff pressure Pc, the cutoff valve 124 is engaged in operation, causing the motor displacement q to increase to the maximum displacement qmax so as to prevent over-rotation of the hydraulic motor 135.

Figure 8:
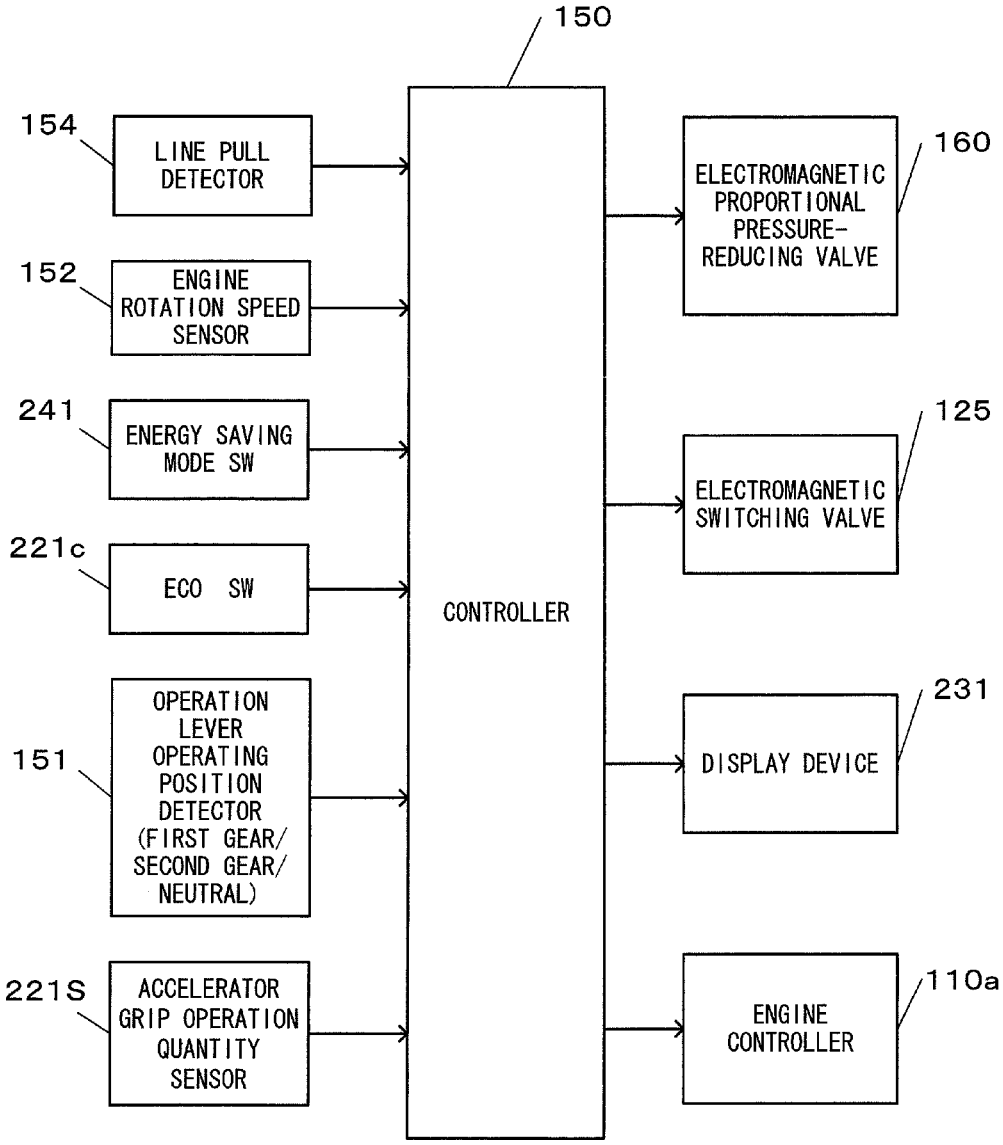
FIG. 8 is a block diagram showing the structure of the winch control device.

FIG. 8 is a block diagram showing the structure adopted in the winch control device. The controller 150 is a control device that controls various parts of the crane 1 and comprises a CPU that executes various types of arithmetic operations, a memory used as a storage device and other peripheral devices. An engine controller 110*a* is connected to the controller 150. The engine controller 110*a* is a control device that controls the engine 110 by starting up the engine 110, engaging it in operation at a specific rotation speed, stopping it and the like, and comprises a CPU which executes various types of arithmetic operations, a memory used as a storage device and other peripheral devices.

An operating position detector 151 that detects an operating position (operation quantity) taken by the winch operation lever 213, an engine rotation speed sensor 152 that detects an actual rotation speed Na of the engine 110, an operation quantity sensor 221S that detects the extent to which the accelerator grip 221*a* is operated, the energy saving mode switch 241, the ECO switch 221*c*, a line pull detector 154, the electromagnetic proportional pressure-reducing valve 160, the electromagnetic switching valve 125 and the display device 231 are all connected to the controller 150.

The operating position detector 151 may be constituted with a pressure sensor (not shown in FIG. 5) that detects the pilot pressure output from the pilot valve 213*a* or 213*b*. As an alternative, the operating position detector 151 may be constituted with a stroke sensor capable of detecting the lever stroke instead of a pilot pressure sensor.

The controller 150 controls the actual rotation speed Na of the engine 110 by setting a target rotation speed Nt for the engine 110 in correspondence to the operation quantity at the accelerator grip 221*a* detected via the operation quantity sensor 221S and outputting a target rotation speed command to the engine controller 110*a*.

Figure 9A:
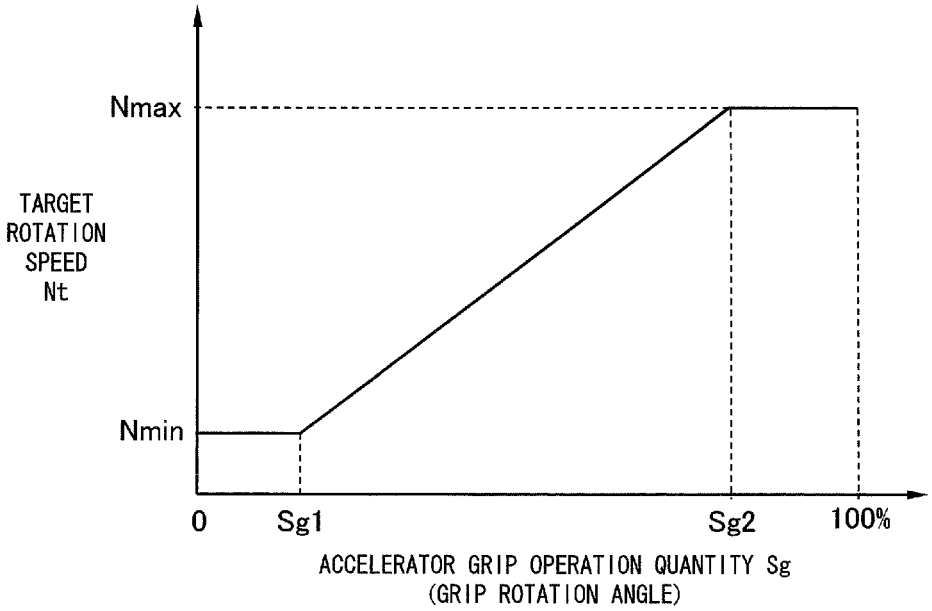
FIG. 9A indicates the relationship between the extent to which the accelerator grip is operated and the target engine rotation speed, whereas FIG. 9B indicates the relationship between the target rotation speed and the actual engine rotation speed.
Figure 9B:
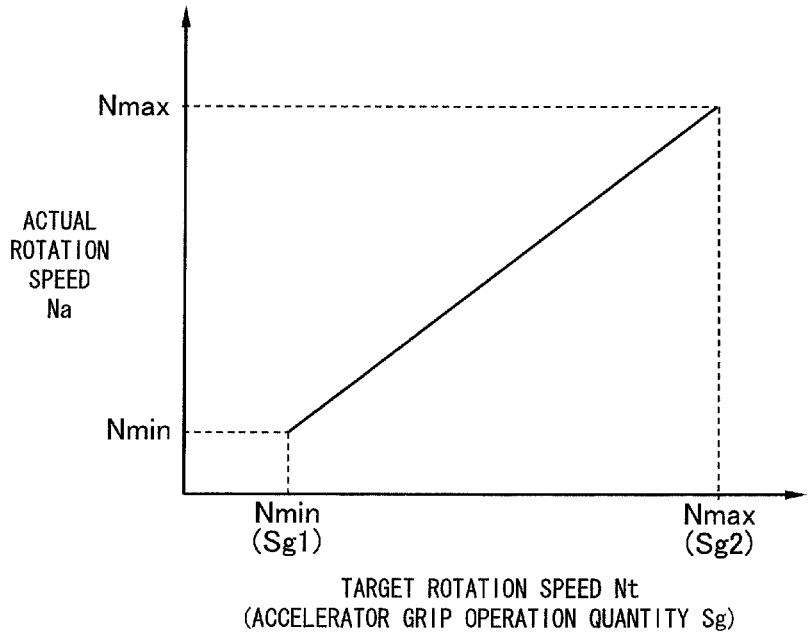

FIG. 9A indicates the relationship between the operation quantity Sg at the accelerator grip 221*a* and the target rotation speed Nt set for the engine 110. FIG. 9B indicates the relationship between the target rotation speed Nt and the actual rotation speed Na at the engine 110. The target rotation speed Nt is sustained at a minimum rotation speed Nmin over a range in which the operation quantity Sg at the accelerator grip 221*a* is between 0 and Sg1. Over a range in which the operation quantity Sg is between Sg1 and Sg2, the target rotation speed Nt increases in proportion to the increase in the operation quantity Sg, and once the operation quantity Sg becomes equal to or greater than the operation quantity Sg2, the target rotation speed Nt is raised to the maximum rotation speed Nmax. The controller 150 outputs a control signal corresponding to the target rotation speed Nt to the engine controller 110*a*, which, in turn, executes control so as to adjust the actual rotation speed Na of the engine 110 to the target rotation speed Nt.

The engine controller 110*a* compares the actual rotation speed Na of the engine 110, detected via the engine rotation speed sensor 152, with the target rotation speed Nt for the engine 110 provided from the controller 150, and controls a fuel injection device (not shown) so as to adjust the actual rotation speed Na of the engine 110 closer to the target rotation speed Nt. Namely, the engine controller 110*a* controls the actual rotation speed Na of the engine 110 over the range between the minimum rotation speed Nmin and the maximum rotation speed Nmax, in correspondence to the operation quantity Sg at the accelerator grip 221*a* detected via the operation quantity sensor 221S located at the accelerator grip 221*a*.

A predetermined rotation speed Ns is stored as a threshold value in the storage device at the controller 150. The predetermined rotation speed Ns is set by selecting a value at which no over-rotation occurs at the hydraulic motor 135, operating at the minimum motor displacement qmin even when a combined flow of the pressure oil output from the first pump 131 and the pressure oil output from the second pump 132, both driven by the engine 110, is delivered to the hydraulic motor 135. In the embodiment, the predetermined rotation speed Ns is set to approximately 50 to 60% of the maximum rotation speed Nmax. It is to be noted that the minimum rotation speed Nmin should be approximately 40% of the maximum rotation speed Nmax.

The energy saving mode switch 241 is a mode selector switch that selects either a limit mode, in which control is executed to regulate the motor displacement of the hydraulic motor 135 at the minimum displacement when the fuel-efficient, high-speed operation condition, to be described in detail later, is established, or a no-limit mode, in which control to regulate the motor displacement of the hydraulic motor 135 at the minimum displacement is not executed even if the fuel-efficient, high-speed operation condition is present.

The controller 150 outputs a specific control current to the electromagnetic proportional pressure-reducing valve 160 in correspondence to the operating position of the winch operation lever 213 detected via the operating position detector 151. When the fuel-efficient, high-speed operation condition, to be described later, is not present, the controller 150 outputs the control current I set at I2 (I2<Imax) if the winch operation lever 213 is currently set at the second gear detent position but outputs the control current I set at I1 (I1<I2) if the winch operation lever 213 is set at the first gear detent position. Once the energy efficient high-speed operation condition is established, the controller 150 outputs the control current I set at Imax.

When the energy saving mode switch 241 is in an ON state, the controller 150 outputs a control signal generated in correspondence to the operation quantity at the winch operation lever 213, to displacement angle control devices (not shown) disposed at the first pump 131 and the second pump 132. When the energy saving mode switch 241 is in the ON state, the quantities of pressure oil output from the first pump 131 and the second pump 132 both increase proportionally as the operation quantity at the winch operation lever 213 increases.

The controller 150 outputs a control signal corresponding to the operation quantity at the winch operation lever 213 to the displacement angle control devices (not shown) disposed at the first pump 131 and the second pump 132. The pump outputs increase proportionally as the operation quantity at the winch operation lever 213 increases.

The ECO switch 221*c* is a selector switch via which the limit mode having been selected at the energy saving mode switch 241 is either validated or invalidated. As the energy saving mode switch 241 is turned on, the display device 231 brings up on display an "ECO" display screen and once the energy saving mode condition to be described in detail later is established, it switches to a highlighted display of the "ECO" display screen.

The line pull detector 154, which may be, for instance, a pin-type load cell, detects a line pull T at the winch drum applied via the rope. A predetermined value Ts is stored as a threshold value in the storage device at the controller 150. The predetermined value Ts is selected in correspondence to the largest hook among a plurality of different hooks that may be attached to the lifting rope 104 at the crane 1.

The controller 150 decides that the energy saving mode condition has been established in the crane 1 in the embodiment if the following conditions (a) through (d) are all satisfied.

(a) The energy saving mode switch 241 is detected to be set at the ON position.

(b) The ECO switch 221*c* is detected to be set at the ON position.

(c) The line pull T is detected to be equal to or less than the predetermined value Ts.

(d) The actual rotation speed Na of the engine 110 is detected to be equal to or lower than the predetermined rotation speed Ns.

Once the energy saving mode condition is established, the crane 1 enters a second gear operation standby state in which the winch can be spooled in or spooled out at high speed. As the winch operation lever 213 is moved from the low-speed (first gear) side hoisting/lowering operating position to the high-speed (second gear) side hoisting/lowering operating position in this state, the controller 150 decides that the energy efficient high-speed operation condition is established. Once the energy efficient high-speed operation condition is established, the controller 150 controls the motor displacement control device 120 so as to decrease the motor displacement (motor tilt angle) at the hydraulic motor 135 down to the minimum displacement qmin. Through these measures, the hydraulic motor 135 can be set to third gear, at which it can be driven at even higher speed than at second gear. In third gear, the winch drum is allowed to rotate either along the hoisting direction or along the lowering direction at higher speed than in second gear, provided that the engine is rotating at the predetermined rotation speed Ns.

Figure 10:
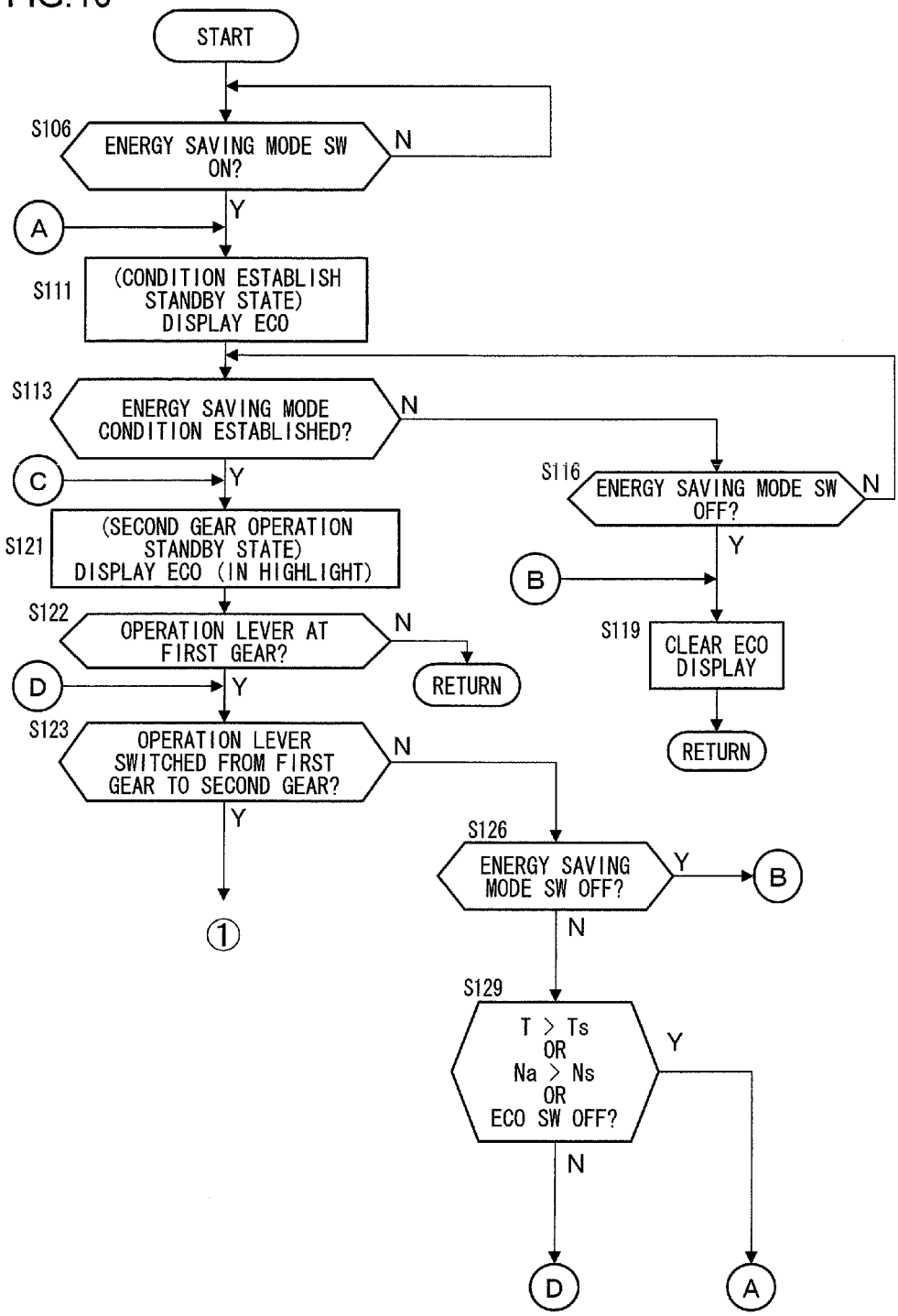
FIG. 10 presents a flowchart of processing that may be executed in the controller.
Figure 11:
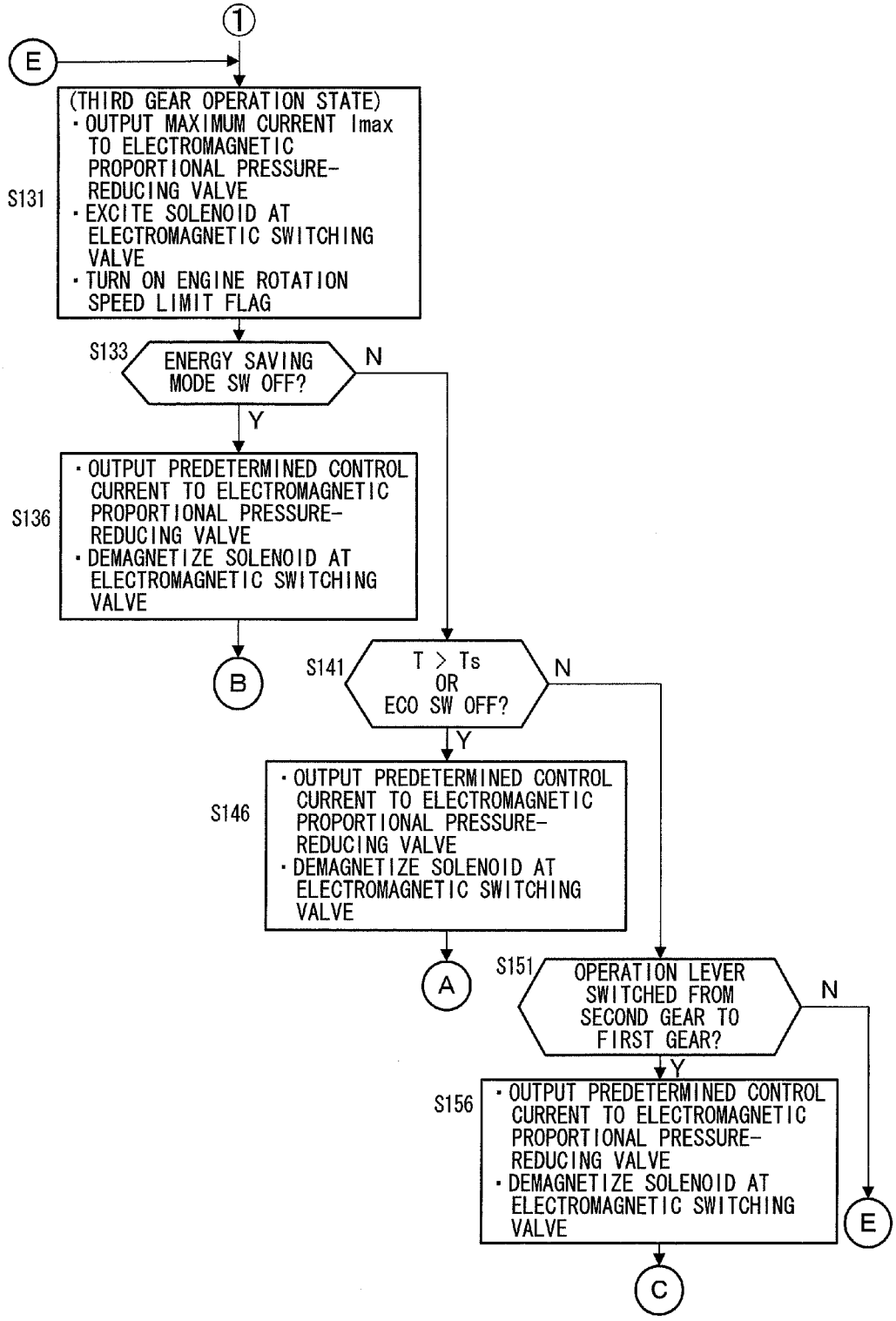
FIG. 11 presents a flowchart of processing that may be executed in the controller.

FIGS. 10 and 11 present a flowchart of processing that may be executed in the controller 150. As an engine key switch is turned on, a program enabling the processing in FIGS. 10 and 11 is started up and executed by the controller 150. In step S106, the controller 150 waits in standby for the energy saving mode switch to enter the ON state. Once an affirmative decision is made in step S106, the operation proceeds to step S111, in which the controller 150 outputs a control signal for the display device 231 so as to bring up the "ECO" display screen. This particular state will be referred to as a condition establish standby state.

In the following step S113, the controller 150 makes a decision as to whether or not the energy saving mode condition explained earlier has been established. In other words, it makes a decision as to whether or not the conditions (a) through (d) listed earlier are all satisfied. If a negative decision is made in step S113, the operation proceeds to step S116 to make a decision as to whether or not the energy saving mode switch 241 has been turned off. If an affirmative decision is made in step S116, the operation proceeds to step S119, whereas if a negative decision is made in step S116, the operation returns to step S113. In step S119, the controller 150 outputs a control signal for the display device 231 so as to clear the "ECO" display screen before making a return.

If an affirmative decision is made in step S113, the operation proceeds to step S121, in which the controller 150 outputs a control signal for the display device 231 so as to switch to a highlighted display of the "ECO" display screen. This particular state will be referred to as a second gear operation standby state.

In the second gear operation standby state, the controller 150 makes a decision as to whether or not the winch operation lever 213 is set at a first gear position. If the controller 150 decides in step S122 that the operating position of the winch operation lever 213, detected via the position detector 151, is the first gear position, the operation proceeds to step S123. If, on the other hand, a negative decision is made in step S122, the operation makes a return.

In step S123, the controller 150 makes a decision as to whether or not the winch operation lever 213 has been operated from the first gear position to the second gear position, i.e., from the low-speed setting toward the high-speed setting. If a negative decision is made in step S123, the operation proceeds to step S126, in which the controller 150 makes a decision as to whether or not the energy saving mode switch 241 has been turned off. If an affirmative decision is made in step S126, the operation returns to step S119.

If a negative decision is made in step S126, the operation proceeds to step S129, in which the controller 150 makes a decision as to whether or not the line pull T, detected via the line pull detector 154, is greater than the predetermined value Ts, whether or not the actual rotation speed Na of the engine 110, detected via the engine rotation speed sensor 152, is higher than the predetermined rotation speed Ns, or whether or not the ECO switch 221*c* has been turned off.

If an affirmative decision is made in step S129, the operation returns to step S111, whereas if a negative decision is made in step S129, the operation returns to step S123. If an affirmative decision is made in step S123, the operation proceeds to step S131.

In step S131 (see FIG. 11), the controller 150 outputs the control current I set at Imax to the solenoid at the electromagnetic proportional pressure-reducing valve 160, excites the solenoid at the electromagnetic switching valve 125, and turns on an engine rotation speed limit flag. This particular state will be referred to as a third gear operation state.

In the third gear operation state, the controller 150 makes a decision in step S133 as to whether or not the energy saving mode switch 241 has been turned off. If an affirmative decision is made in step S133, the controller 150 outputs the control current I corresponding to the operation quantity at the winch operation lever 213 to the solenoid at the electromagnetic proportional pressure-reducing valve 160 in step S136 and demagnetizes the solenoid at the electromagnetic switching valve 125 before the operation returns to step S119.

If a negative decision is made in step S133, the controller 150 makes a decision in step S141 as to whether or not the line pull T, detected via the line pull detector 154, is greater than the predetermined value Ts or whether or not the ECO switch 221*c* has been turned off. If an affirmative decision is made in step S141, the controller outputs the control current I corresponding to the operation quantity at the winch operation lever 213 to the solenoid at the electromagnetic proportional pressure-reducing valve 160 and demagnetizes the solenoid at the electromagnetic switching valve 125, before the operation returns to step S111.

Upon making a negative decision in step S141, the controller 150 makes a decision as to whether or not the winch operation lever 213 has been operated to switch from the second gear position to the first gear position, i.e., from the high-speed setting to the low-speed setting. If a negative decision is made in step S151, the operation returns to step S131, whereas if an affirmative decision is made in step S151, the operation proceeds to step S156. In step S156, the controller 150 outputs the control current I corresponding to the operation quantity at the winch operation lever 213 to the solenoid of the electromagnetic proportional pressure-reducing valve 160 and demagnetizes the solenoid at the electromagnetic switching valve 125, before the operation returns to step S121.

Figure 12A:
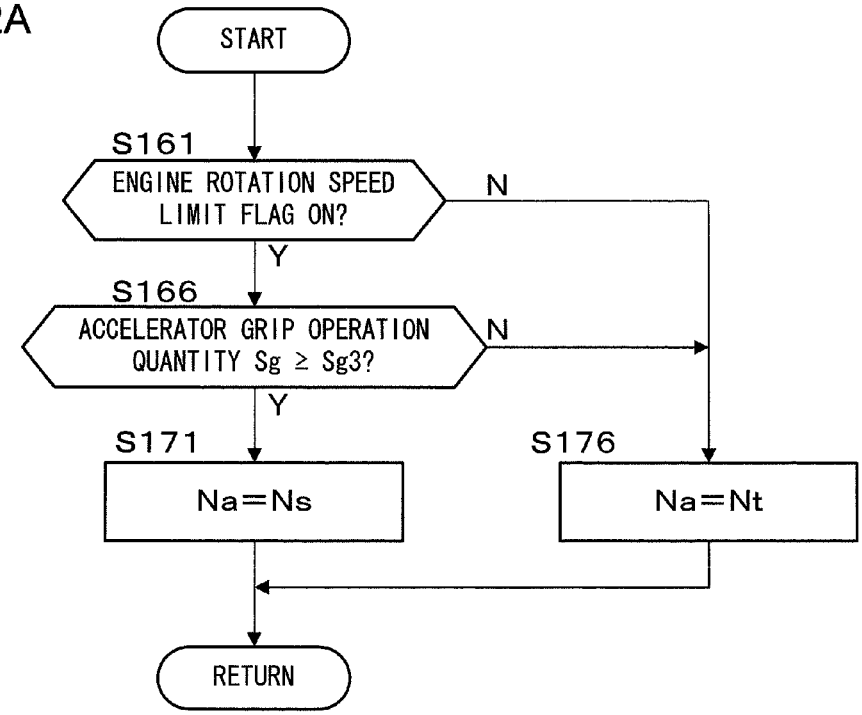
FIGS. 12A and 12B present flowcharts indicating the operational flows of engine rotation speed limit processing and engine rotation speed limit flag clearance processing.
Figure 12B:
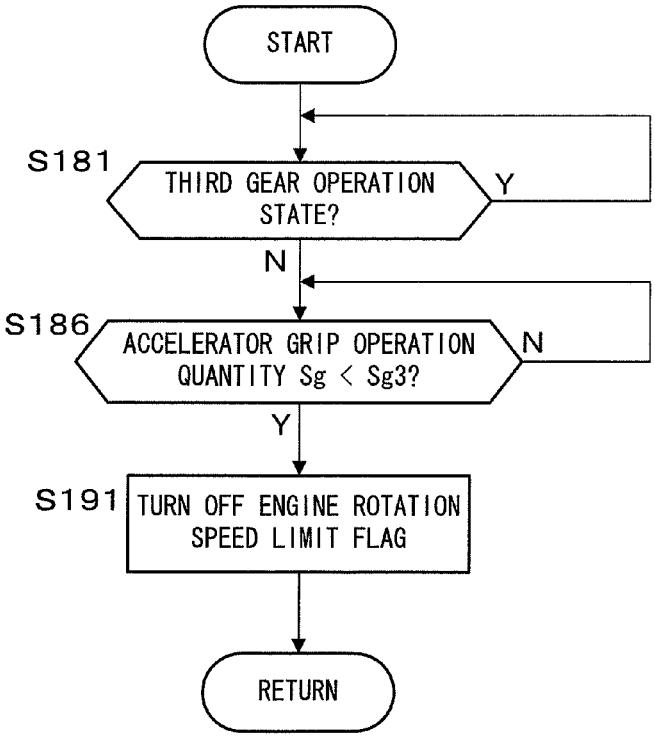
Figure 13:
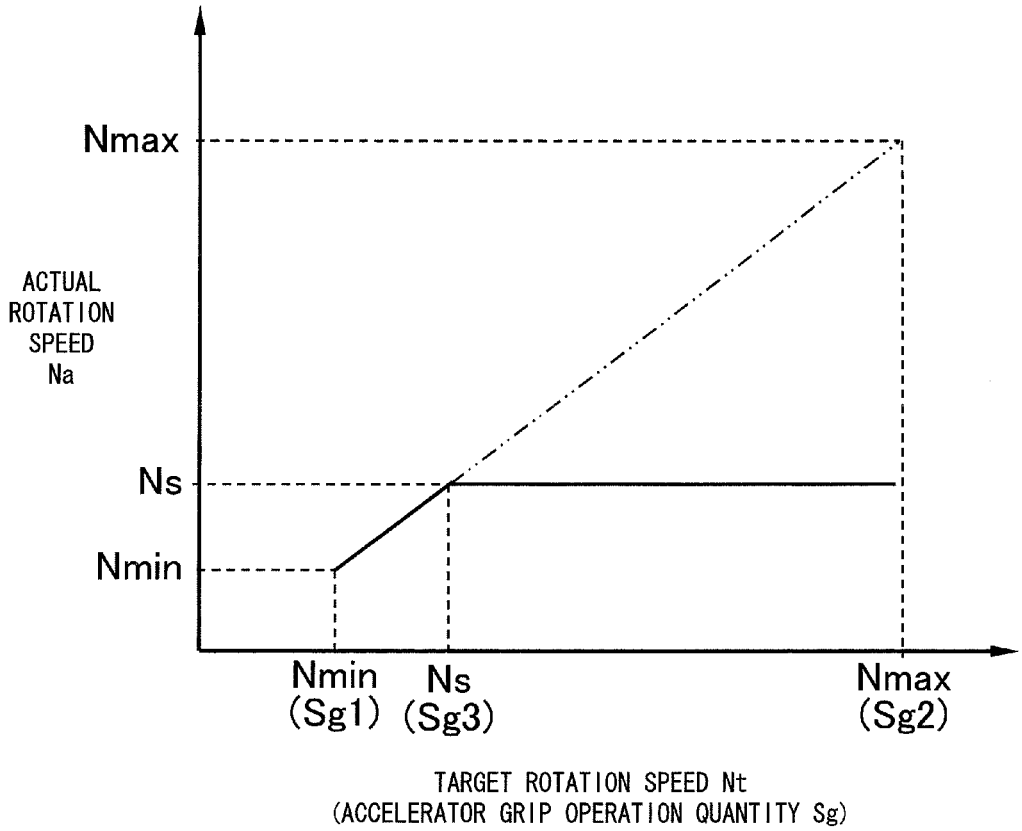
FIG. 13 indicates the upper limit to the actual engine rotation speed.

FIGS. 12A and 12B present flowcharts indicating the operational flows of engine rotation speed limit processing and engine rotation speed limit flag clearance processing. As FIG. 12A shows, the controller 150 makes a decision in step S161 as to whether or not the engine rotation speed limit flag is currently on. Upon making an affirmative decision in step S161, the operation proceeds to step S166, in which the controller 150 makes a decision as to whether or not the operation quantity Sg at the accelerator grip 221*a* is equal to or greater than a predetermined operation quantity Sg3. As indicated in FIG. 13, the predetermined operation quantity Sg3 is equivalent to the operation quantity at which the target rotation speed Nt matches Ns.

Upon making an affirmative decision in step S166, the controller 150 outputs a control signal for the engine controller 110*a* so as to limit the actual rotation speed Na of the engine 110 to the predetermined rotation speed Ns, before the operation makes a return. After making a negative decision in step S161 or S166, the operation proceeds to step S176, in which the controller 150 outputs a control signal for the engine controller 110*a* so as to control the actual rotation speed Na of the engine 110 to match the target rotation speed Nt. The operation then makes a return.

As described above, once the engine rotation speed limit flag is turned on in step S131, the engine controller 110*a* sets the predetermined rotation speed Ns, which is lower than the maximum rotation speed Nmax, as the upper limit to the actual rotation speed Na of the engine 110. As a result, as long as the engine rotation speed limit flag remains on, the actual rotation speed Na of the engine 110 is regulated so as to not exceed the predetermined rotation speed Ns, even if the target rotation speed Nt, indicated in a command value output based upon the operation quantity Sg at the accelerator grip 221*a*, is represented by a value greater than that representing the predetermined rotation speed Ns, as indicated in FIG. 13.

As FIG. 12B shows, the controller 150 makes a decision in step S181 as to whether or not the crane 1 is currently in the third gear operation state. Upon making a negative decision in step S181, the operation proceeds to step S186, in which the controller 150 makes a decision as to whether or not the operation quantity Sg at the accelerator grip 221*a* is less than the predetermined operation quantity Sg3.

Upon making an affirmative decision in step S186, the operation proceeds to step S191, in which the controller 150 turns off the engine rotation speed limit flag, before the operation makes a return. As a result, the engine controller 110*a* is able to set the upper limit to the actual rotation speed Na of the engine 110 at the maximum rotation speed Nmax and control the fuel injection device (not shown) so as to adjust the actual rotation speed Na of the engine 110 to the speed represented by the command value (target rotation speed Nt) output based upon the operation quantity Sg at the accelerator grip 221*a*, which is input to the controller 150.

Figure 14:
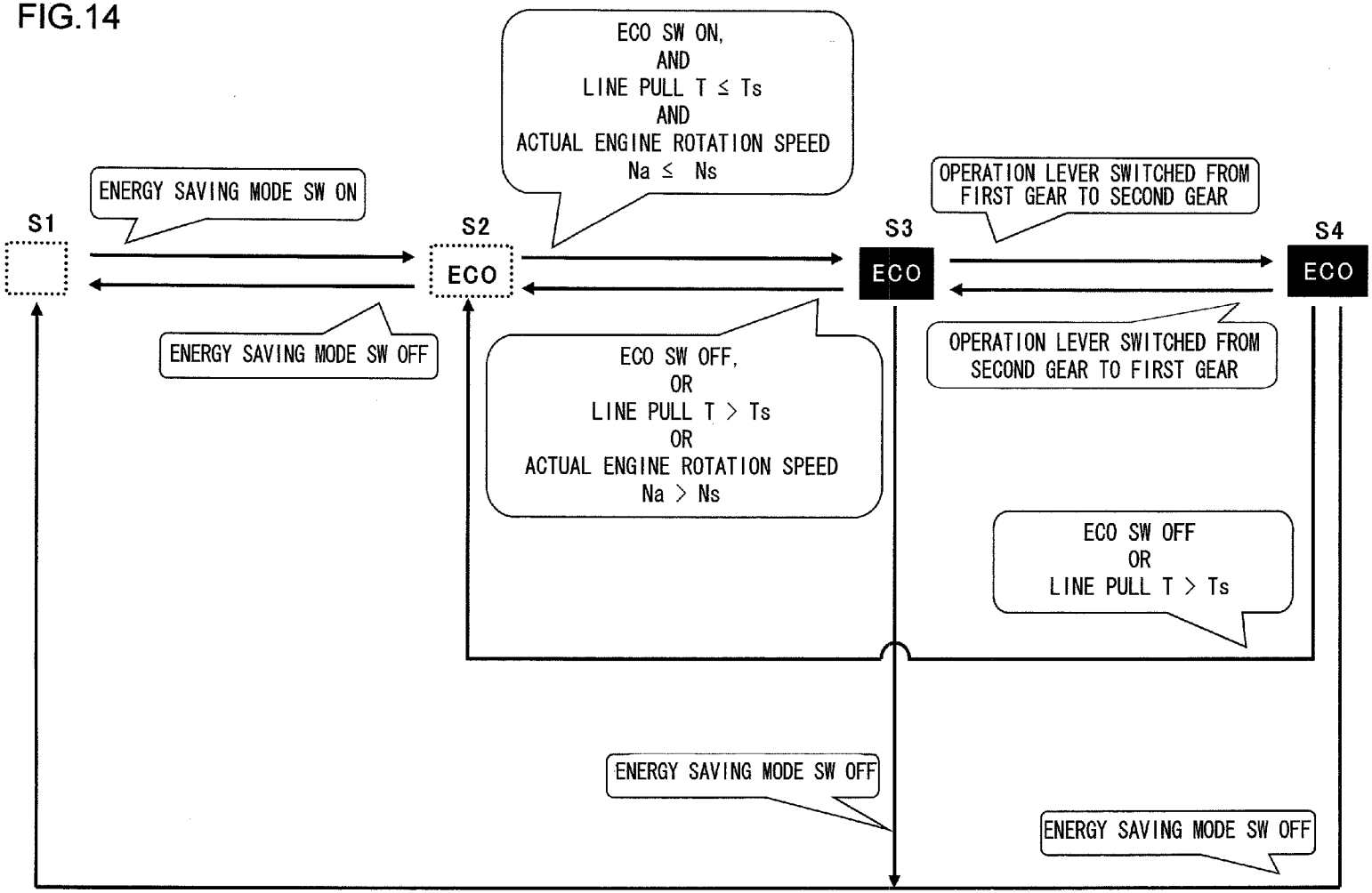
FIG. 14 is a state transition diagram pertaining to the hydraulic winch control device.

The main operations executed in the crane 1 achieved in the embodiment are summarized below in reference to the state transition diagram in FIG. 14. As the energy saving mode switch 241 is turned on in an initial state S1, the crane 1 shifts into the condition establish standby state S2 and the "ECO" display screen is brought up on display at the display device 231 (steps S106, S111). If the ECO switch 221*c* is turned on, the line pull T is equal to or less than the predetermined value Ts and the actual rotation speed Na of the engine 110 is equal to or lower than the predetermined rotation speed Ns in the crane 1 in the condition establish standby state S2, the crane 1 shifts into a second gear operation standby state S3 and the "ECO" display screen is displayed in highlight (steps S113, S121).

As the winch operation lever 213 is moved from the hoisting/lowering first gear detent position, toward the hoisting/lowering second gear detent position in the second gear operation standby state S3, the crane 1 shifts into a third gear operation state S4 (steps S123, S131). In the third gear operation state S4, the motor displacement q of the hydraulic motor 135 decreases in relation to the motor displacement q in the state S3 and is controlled to the minimum capacity qmin. This third gear state, in which the winch drum is allowed to rotate at higher speed than in the first gear state or in the second gear state, is achieved with the pressure oil output from the first pump 131 and the pressure oil output from the second pump 132 jointly delivered to the hydraulic motor 135.

In the third gear operation state S4, the actual rotation speed Na of the engine 110 is regulated so as not to exceed Ns even if the accelerator grip is operated to an extent at which the operation quantity Sg is equal to or greater than the predetermined operation quantity Sg3 (steps S131, S161, S166, S171). In the third gear operation state S4, the cutoff pressure is raised (step S131) and thus, a greater work range can be assumed in correspondence to the motor displacement q adjusted to the minimum displacement qmin.

If the winch operation lever 213 is moved from the second gear position to the first gear position in the third gear operation state S4, the crane 1 reverts to the second gear operation standby state S3 (steps S151, S156). It is to be noted that even if the winch operation lever 213 is operated to switch from the second gear position to the first gear position with the accelerator grip operated to an extent at which the operation quantity Sg is equal to or greater than Sg3 in the third gear operation state S4, the actual rotation speed Na of the engine 110 is controlled so as not to exceed Ns. In this manner, any abrupt increase in the actual rotation speed Na of the engine 110, against the intention of the operator wishing to adjust the speed from third gear to first gear, is effectively prevented (steps S161, S166, S171, S181, S186, S191).

If the ECO switch 221*c* is turned off in the third gear operation state S4, the crane 1 shifts into the condition establish standby state S2 (steps S141, S146). The operator is able to reduce the hoisting/lowering speed simply by turning off the ECO switch 221*c*. In addition, when the load initially set on the ground (with the line pull T equal to or less than the predetermined value Ts) is hoisted, after the crane 1 shifts into the third gear operation state S4, the crane 1 shifts into the condition establish standby state S2 once the line pull T becomes greater than the predetermined value Ts with the load lifted off the ground (steps S141, S146). Through these steps, it is ensured that the load is not hoisted in the third gear operation state S4.

If the ECO switch 221*c* is turned off, the line pull T becomes greater than the predetermined value Ts or the actual rotation speed Na of the engine 110 becomes higher than the predetermined rotation speed Ns in the second gear operation standby state S3, the crane 1 shifts into the condition establish standby state S2 (step S129). As the energy saving mode switch 241 is turned off while the crane is in the condition establish standby state S2, the second gear operation standby state S3 or the third gear operation state S4, the crane shifts into the initial state S1 (steps S116, S119, S126, S133, S136).

The following advantages are achieved through the embodiment described above.

(1) As the winch operation lever 213 is moved from a low-speed side hoisting/lowering operating position (hoisting/lowering first gear detent position), to a high-speed side hoisting/lowering operating position (hoisting/lowering second gear detent position while the actual rotation speed Na of the engine 110 is equal to or lower than the predetermined rotation speed Ns and the line pull T is equal to or less than the predetermined value Ts, the motor displacement q of the hydraulic motor 135 is reduced so as to be controlled to the minimum capacity qmin and the upper limit to the actual rotation speed Na of the engine 110 is set to the predetermined rotation speed Ns, which is lower than the maximum rotation speed Nmax.

As a result, the hook 106 can be hoisted/lowered at high speed while keeping down the actual rotation speed Na of the engine 110 as long as the crane 1 is in a light load condition, e.g., when no load is suspended. Thus, high-speed hoisting/lowering operation can be executed while assuring fuel efficiency.

(2) In the embodiment, one of the requirements for establishing the fuel-efficient, high-speed operation condition is that the line pull T be equal to or less than the predetermined value Ts. This means that hoisting/lowering operation in third gear, i.e., at higher speed than first gear or second gear, can be performed only if the line pull is not significant, i.e., only if the suspended load is insignificant. As a result, the shock occurring as the hook 106 is stopped can be minimized. The hydraulic winch control device disclosed in the publication cited above does not detect the line pull, and allows high-speed lowering operation to be performed as long as the engine rotation speed is equal to or less than a predetermined engine rotation speed even if a hanging load is attached to the hook 106 and the line pull becomes equal to or greater than a predetermined value, giving rise to a concern that a significant shock may occur as the hook 106 comes to a stop. In contrast, high speed (third gear) hoisting or lowering operation is never performed in the embodiment if the line pull T is greater than the predetermined value Ts as described earlier and thus, no significant shock occurs when the hook 106 stops.

(3) As explained above, one of the requirements for establishing the fuel-efficient, high-speed operation condition is that the line pull T be equal to or less than the predetermined value Ts. Thus, it is ensured that a hanging load is not hoisted from the ground in the third gear operation state in which the actual rotation speed of the engine 110 is regulated during, for instance, a dynamic lift-off. The publication cited above discloses a technology whereby the motor displacement is controlled so that the minimum displacement is adjusted to a very small displacement value and the engine rotation speed is regulated so as not to exceed a predetermined speed when the energy saving mode switch is in the ON state. In this related art, as the motor circuit pressure rises in order to lower a heavy hanging load and it reaches a level equal to or higher than a predetermined pressure, the cutoff valve is engaged in operation so as to execute control to achieve a larger motor displacement, resulting in a decrease in the lowering speed. In this situation, the engine rotation speed is regulated so as not to exceed the predetermined speed, and thus, the driver, wishing to achieve a desired work speed, needs to raise the engine rotation speed after turning off the energy saving mode switch. The embodiment is distinguishable in that one of the requirements for establishing the fuel-efficient, high-speed operation condition is that the line pull T be equal to or less than the predetermined value Ts, preempting any scenario in which the need for performing a cumbersome operation, such as that required in the related art, may arise.

(4) In the embodiment, if the line pull T exceeds the predetermined value Ts while the upper limit to the engine rotation speed is set at the predetermined rotation speed Ns, which is lower than the maximum rotation speed Nmax, the upper limit to the engine rotation speed is adjusted to the maximum rotation speed Nmax. This means that as the hanging load, initially set on the ground, is hoisted, after the crane 1 shifts into the third-gear operation state S4, and the line pull T becomes greater than the predetermined value Ts with the hanging load lifted off the ground during, for instance, a dynamic lift-off of the hanging load from the ground, an automatic switchover from third gear to second gear occurs and the restriction on the rotation speed of the engine 110 is cleared. As a result, the operator is able to work at a desired work speed without having to perform any extra operation such as turning off the ECO switch 221*c* in order to raise the engine rotation speed.

(5) One of the requirements for establishing the fuel-efficient, high-speed operation condition is that the winch operation lever 213, set at a low-speed side hoisting/lowering operating position, be operated toward the high-speed side hoisting/lowering operating position. In other words, the fuel-efficient, high-speed operation condition is never established even if the energy saving mode condition is met when the winch operation lever 213 is already set at the high-speed side hoisting/lowering operating position. For instance, a technology, whereby the fuel-efficient, high-speed operation condition is established if the energy saving mode condition is met when the winch operation lever is already set at the high-speed side hoisting/lowering operating position, will be examined for comparison. In the comparison example, if the winch operation lever 213 is operated toward the high-speed side lowering operating position with the hanging load 106*a* attached to the hook 106, the hanging load 106*a* is lowered in second gear (at high speed). The technology in the comparison example gives rise to a concern that the descending speed may increase against the will of the operator as the hanging load 106*a* is lowered and touches the ground and then the line pull T becomes equal to or less than the predetermined value Ts, thereby establishing the fuel-efficient, high-speed operation condition. In this situation, the rope may spool out unintentionally, which is not desirable. In the embodiment, any unintended increase in the lowering speed can be prevented, since the witch drum is allowed to rotate in third gear, i.e., at higher speed than first gear or second gear, only when the winch operation lever is moved from the low-speed side hoisting/lowering operating position toward the high-speed side hoisting/lowering operating position.

(6) The control device includes the energy saving mode switch 241, via which either the limit mode for controlling the motor displacement q of the hydraulic motor 135 at the minimum displacement qmin when the fuel-efficient, high-speed operation condition is established or the no-limit mode for not controlling the motor displacement q of the hydraulic motor 135 at the minimum displacement qmin even when the fuel-efficient, high-speed operation condition is established can be selected. The energy saving mode switch 241 allows the operator to choose whether or not to perform fuel-efficient third gear operation depending upon the type of work. Since the energy saving mode switch 241 is installed at a position where it cannot be operated at once by the operator during lever operation, any erroneous operation is prevented.

(7) The ECO switch 221*c*, operated to validate or invalidate the limit mode having been selected via the energy saving mode switch 241, is disposed at the handle portion 221*d* of the revolution lever 221. Thus, the operator is able to shift from the fuel-efficient, third gear operation to the regular high-speed operation (second gear) as he wishes.

(8) If the winch operation lever 213 is moved from a high-speed side hoisting/lowering operating position to the low-speed side hoisting/lowering operating position while the motor displacement q of the hydraulic motor 135 is controlled at the minimum displacement qmin, control is executed so as to adjust the motor displacement q of the hydraulic motor 135 to a predetermined displacement greater than the minimum displacement qmin, i.e., to a motor displacement q corresponding to the operation quantity at the winch operation lever 213. This allows the operator to shift from the fuel-efficient third gear operation to the regular low speed operation (first gear) with ease.

(9) Upon deciding that the fuel-efficient, high-speed operation condition has been established, cutoff pressure Pc is raised. Through these measures, an increase in the motor displacement q attributable to an increase in the circuit pressure is prevented during third gear operation. In other words, the work range is expanded compared to that in the regular operating state (first gear or second gear) during the fuel-efficient, third gear operation.

(10) If it is decided, while the upper limit to the actual rotation speed Na of the engine 110 is controlled at the predetermined rotation speed Ns, that the winch operation lever has been moved from a high-speed side hoisting/lowering operating position to a low-speed side hoisting/lowering operating position and that the target rotation speed Nt is lower than the predetermined rotation speed Ns, the upper limit to the actual rotation speed Na of the engine 110 is adjusted to the maximum rotation speed Nmax. In other words, if the winch operation lever 213 is switched from the high-speed side hoisting/lowering operating position to the low-speed side hoisting/lowering operating position while a target rotation speed Nt higher than the predetermined rotation speed Ns is detected as a result of a full stroke operation of the accelerator grip 221*a* performed by the operator after the fuel-efficient, high-speed operation condition is established, the crane, having been engaged in fuel-efficient third gear operation, resumes regular operation. However, since the actual rotation speed Na of the engine 110 remains controlled so as not to exceed the predetermined rotation speed Ns, an abrupt increase in the actual rotation speed Na of the engine 110 is prevented.

The following variations are also within the scope of the present invention and one of the variations or a plurality of variations may be adopted in combination with the embodiment described above.

(Variations)

(1) In the embodiment described above, it is decided that the energy saving mode condition has been established when all the conditions (a) through (d) explained earlier are satisfied. However, the present invention is not limited to this example. For instance, the present invention may be adopted in a structure that does not include the ECO switch 221*c* and in such a case, the conditions (b) does not need to be satisfied. In addition, in place of the ECO switch 221*c*, a cancel switch (not shown) operated to switch from third gear operation to regular operation may be disposed at the revolution lever 221. Furthermore, the present invention may be adopted in a structure that does not include the energy saving mode switch 241 and in such a case, the conditions (a) and (b) do not need to be satisfied.

(2) The hydraulic circuit in the embodiment described above includes two hydraulic pumps (the first pump 131 and the second pump 132), the pressure oil output from the first pump 131 is delivered to the hydraulic motor 135 in first gear operation, and the pressure oil output from the first pump 131 and the pressure oil output from the second pump 132 are jointly delivered to the hydraulic motor 135 during second gear operation or third gear operation. However, the present invention is not limited to this example. For instance, the hydraulic circuit in FIG. 5 may instead include a single hydraulic pump used as a hydraulic source that provides pressure oil to the hydraulic motor 135. In such a case, by causing the motor displacement in first gear operation to be different from that in second gear, the rotation speed of the winch drum can be increased.

(3) While the cutoff pressure Pc is raised when the energy efficient high-speed operation condition has been established in the embodiment described above, the present invention is not limited to this example and the cutoff pressure Pc does not need to be raised.

(4) In the embodiment described above, one of the requirements for establishing the fuel-efficient, high-speed operation condition and the energy saving mode condition is that the actual rotation speed Na of the engine 110, detected via the engine rotation speed sensor 152, be equal to or less than the predetermined threshold value Ns. However, the present invention is not limited to this example. For instance, a requirement for establishing the fuel-efficient, high-speed operation condition and the energy saving mode condition may be that the target rotation speed Nt calculated in correspondence to the operation quantity at the accelerator grip 221*a* detected via the operation quantity sensor 221S, instead of the actual rotation speed Na of the engine 110, be equal to or less than the predetermined threshold value Ns.

(5) While the accelerator grip 221*a* is used as an accelerator operation member in the embodiment described above, the present invention is not limited to this example. The present invention may be adopted in conjunction with any of various other accelerator operation members including the accelerator pedal 261 and an accelerator dial (not shown).

(6) While the control device in the embodiment described above controls hydraulic winches mounted at a crawler crane, the present invention is not limited to this example. Rather, the present invention may be adopted in a control device that controls a hydraulic winch mounted at any of various types of construction machines, such as a tower crane.

The embodiment of the present invention described above makes it possible to minimize the shock that will occur as the hook, hoisted/lowered at high speed, comes to a stop by rotationally driving the hydraulic motor at high speed while keeping down the engine rotation speed.

The embodiment described above is an example and various modifications can be made without departing from the scope of the invention.

What is claimed is:

1. A control device for a hydraulic winch, comprising:

a hydraulic source;

a variable-displacement hydraulic motor that is caused to rotate by pressure oil from the hydraulic source and is used to drive a winch drum;

a winch operation member that outputs a low-speed hoisting/lowering command so as to hoist/lower a hook at low speed when operated to a low-speed side hoisting/lowering operating position and outputs a high-speed hoisting/lowering command so as to hoist/lower the hook at high speed when operated to a high-speed side hoisting/lowering operating position;

an accelerator operation quantity detection unit that detects an operation quantity of an accelerator operation member;

an engine control unit that controls an engine rotation speed at an engine within a range between a minimum rotation speed and a maximum rotation speed, in correspondence to the operation quantity at the accelerator operation member detected by the accelerator operation quantity detection unit;

a rotation speed detection unit that detects the engine rotation speed;

a line pull detection unit that detects a line pull at a hoisting rope;

a condition decision unit that decides that a fuel-efficient, high-speed operation condition is established in response to an operation performed at the winch operation member to switch from the low-speed side hoisting/lowering operating position to the high-speed side hoisting/lowering operating position when the engine rotation speed detected by the rotation speed detection unit is equal to or lower than a predetermined rotation speed and the line pull detected by the line pull detection unit is equal to or less than a predetermined value; and a motor displacement control unit that reduces a motor displacement of the hydraulic motor and controls the motor displacement at a minimum displacement once the condition decision unit decides that the fuel-efficient, high-speed operation condition has been established, wherein:

once the condition decision unit decides that the fuel-efficient, high-speed operation condition has been established, the engine control unit sets an upper limit to the engine rotation speed at a predetermined rotation speed, lower than the maximum rotation speed.

2. A control device for a hydraulic winch according to claim 1, wherein:

the hydraulic source includes at least two hydraulic pumps;

the control device further comprises two directional control valves each switched in response to a command output from the winch operation member, which individually control flows of pressure oil output from the two hydraulic pumps, to the hydraulic motor;

in response to the low-speed hoisting/lowering command output from the winch operation member, only one of the directional control valves is switched so as to deliver pressure oil from one of the two hydraulic pumps to the hydraulic motor; and in response to the high-speed hoisting/lowering command output from the winch operation member, the directional control valves are both switched so as to deliver pressure oil from the two hydraulic pumps to the hydraulic motor.

3. A control device for a hydraulic winch according to claim 1, wherein:

the rotation speed detection unit detects an actual rotation speed of the engine.

4. A control device for a hydraulic winch according to claim 1, further comprising:

a mode selector operation member that selectively switches to a limit mode, in which the motor displacement at the hydraulic motor is controlled by the motor displacement control unit at the minimum displacement when the fuel-efficient, high-speed operation condition has been established or to a no-limit mode in which the motor displacement at the hydraulic motor is not controlled at the minimum displacement even if the fuel-efficient, high-speed operation condition has been established.

5. A control device for a hydraulic winch according to claim 4, further comprising:

an auxiliary selector switch that either validates or invalidates the limit mode having been selected by the mode selector operation member, wherein:

the accelerator operation member includes a handle portion held by an operator seated in an operator's seat; and the auxiliary selector switch is disposed at the handle portion of the accelerator operation member.

6. A control device for a hydraulic winch according to claim 1, wherein:

if the winch operation member is moved from the high-speed side hoisting/lowering operating position to the low-speed side hoisting/lowering operating position while the motor displacement control unit is controlling the motor displacement at the hydraulic motor at the minimum displacement, the motor displacement control unit executes control so as to adjust the motor displacement at the hydraulic motor to a predetermined displacement, greater than the minimum displacement.

7. A control device for a hydraulic winch according to claim 1, wherein:

if the line pull detected by the line pull detection unit becomes greater than the predetermined value when the upper limit to the engine rotation speed set by the engine control unit represents a predetermined rotation speed, which is lower than the maximum rotation speed, the engine control unit adjusts the upper limit to the engine rotation speed to the maximum rotation speed.

8. A control device for a hydraulic winch according to claim 1, wherein:

if the winch operation member is determined to have been operated so as to switch from the high-speed side hoisting/lowering operating position to the low-speed side hoisting/lowering operating position and a command value detected by the accelerator operation quantity detection unit is determined to be less than the predetermined rotation speed while the engine control unit is controlling the upper limit to the engine rotation speed at the predetermined rotation speed, the engine control unit adjusts the upper limit to the engine rotation speed to the maximum rotation speed.

9. A control device for a hydraulic winch according to claim 1, further comprising:

a cutoff unit that regulates the motor displacement when a circuit pressure of the hydraulic motor exceeds a predetermined cutoff pressure; and a cutoff control unit that raises the predetermined cutoff pressure once the condition decision unit decides that the fuel-efficient, high-speed operation condition has been established.

* * * * *